US008381956B2

(12) United States Patent
Gleason, Jr.

(10) Patent No.: US 8,381,956 B2
(45) **Date of Patent: *Feb. 26, 2013**

(54) BACKPACK FRAME SYSTEM

(75) Inventor: Dana W. Gleason, Jr., Bozeman, MT (US)

(73) Assignee: Mystery Ranch, Ltd., Bozeman, MT (US)

( * ) Notice: Subject to any disclaimer, the term of this patent is extended or adjusted under 35 U.S.C. 154(b) by 667 days.

This patent is subject to a terminal disclaimer.

(21) Appl. No.: 12/533,983

(22) Filed: Jul. 31, 2009

(65) Prior Publication Data

US 2010/0032464 A1 Feb. 11, 2010

Related U.S. Application Data

(63) Continuation-in-part of application No. 10/907,087, filed on Mar. 18, 2005.

(51) Int. Cl.
*A45F 3/04* (2006.01)
*A45F 3/10* (2006.01)

(52) U.S. Cl. ..... 224/645; 224/635; 224/637

(58) Field of Classification Search ..... 224/627, 224/628, 630, 631, 633, 634, 635, 636, 645, 224/650, 652, 160, 579, 580, 581, 153
See application file for complete search history.

(56) References Cited

U.S. PATENT DOCUMENTS

| | | | | |
|---|---|---|---|---|
| 4,040,548 | A | 8/1977 | Guglielmo | |
| 4,356,942 | A | 11/1982 | Hayes | |
| 4,361,259 | A | 11/1982 | Chanter | |
| 4,982,884 | A | 1/1991 | Wise | |
| 5,236,113 | A * | 8/1993 | Wisser | 224/243 |
| 5,320,262 | A * | 6/1994 | Levis | 224/630 |
| 5,341,974 | A | 8/1994 | Robinson et al. | |
| 5,361,955 | A | 11/1994 | Gregory | |
| 5,564,612 | A | 10/1996 | Gregory | |
| 5,579,966 | A | 12/1996 | Krumweide et al. | |
| 5,704,530 | A | 1/1998 | Scherer | |
| 5,730,347 | A | 3/1998 | Finot | |
| 5,890,640 | A | 4/1999 | Thompson | |
| 6,135,334 | A | 10/2000 | Seichter | |
| 6,216,926 | B1 | 4/2001 | Pratt | |
| 6,276,584 | B1 | 8/2001 | McLachlan | |
| 6,607,626 | B2 | 8/2003 | Taggart | |
| 6,626,342 | B1 | 9/2003 | Gleason | |
| 6,889,882 | B1 | 5/2005 | Leep | |
| 6,939,423 | B2 | 9/2005 | Taggart | |
| 7,235,149 | B2 | 6/2007 | Taggart | |
| 2004/0178238 | A1 | 9/2004 | Le Gal et al. | |
| 2008/0302839 | A1 * | 12/2008 | Murdoch et al. | 224/153 |

FOREIGN PATENT DOCUMENTS

WO 03057529 A2 7/2003

* cited by examiner

*Primary Examiner* — Justin Larson
(74) *Attorney, Agent, or Firm* — Husch Blackwell LLP

(57) ABSTRACT

The present invention involves the provision of a backpack frame assembly and associated load carrying devices. The backpack frame includes a plurality of stays having flexible joints therebetween. A membrane is secured to certain of the stays and helps resist flexing of joints between adjacent stay end portions. Load carrying devices may be provided and are releasably mounted to the frame assembly. The distance between the assembly's shoulder straps and hip belt can be adjusted to accommodate user's having different torso lengths by using an adjuster sheet to separate hook and look members attaching a shoulder strap assembly to a frame assembly. The adjuster sheet can operate as a support element when not operating as an adjuster. The adjuster sheet can be constructed of a laminated composite material and include reinforcing ribs formed therein.

33 Claims, 17 Drawing Sheets

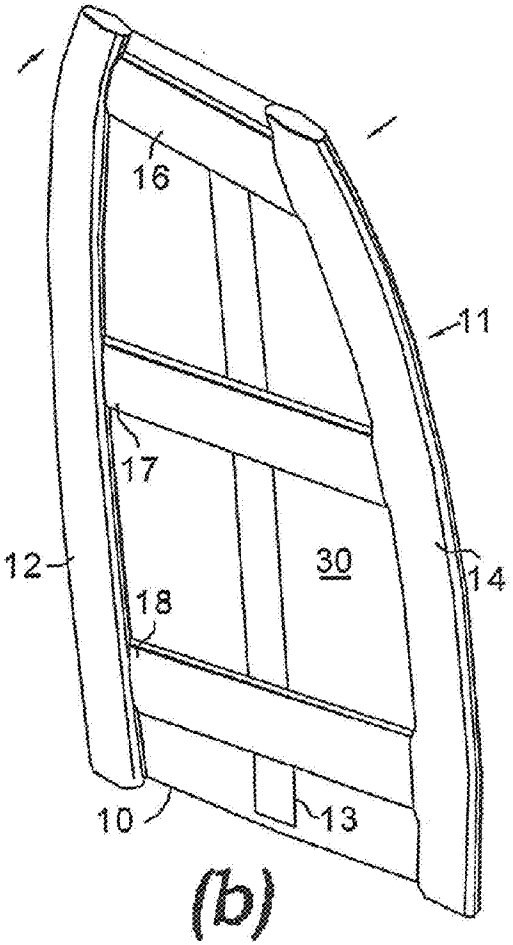
FIG. 3.
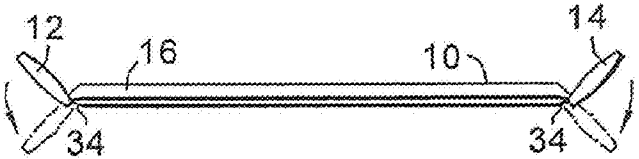

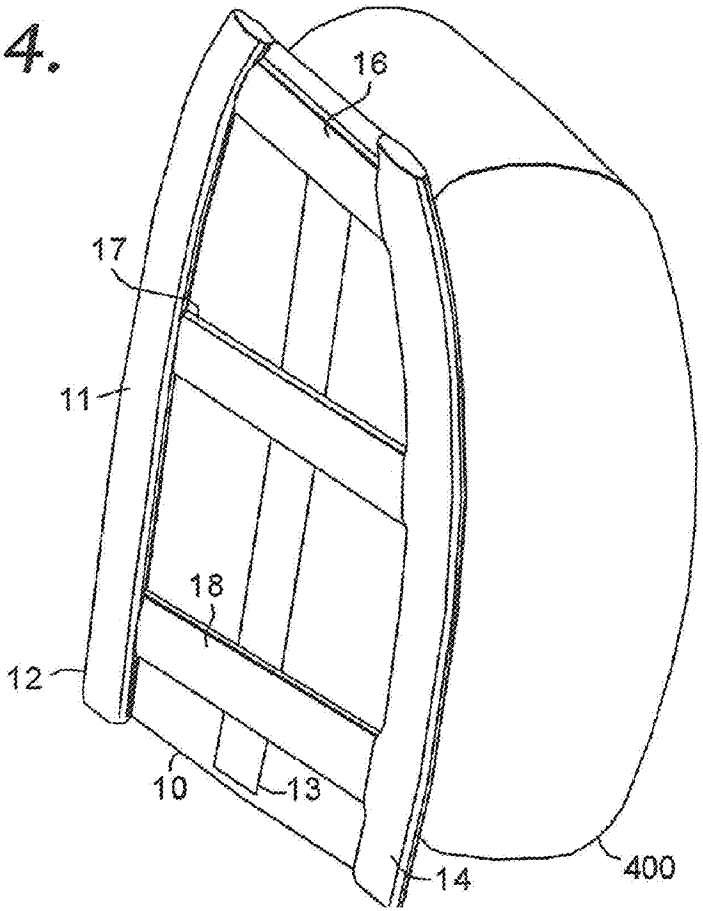
(b)
FIG. 4.
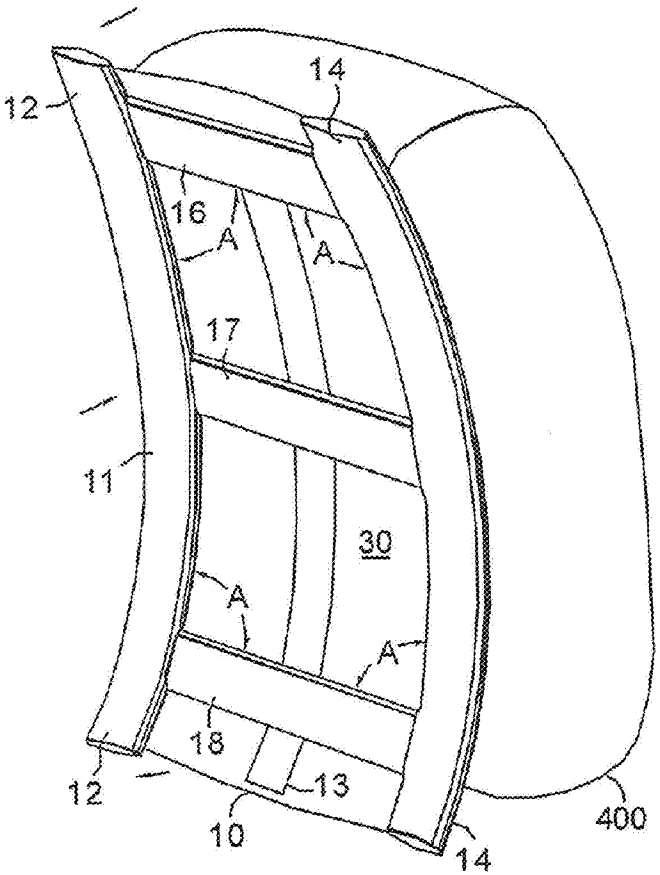
(a)

BACKPACK FRAME SYSTEM

CROSS-REFERENCE TO RELATED APPLICATIONS

This Application is a Continuation-in-Part of and claims priority to U.S. application Ser. No. 10/907,087 filed Mar. 18, 2005 to Dana Wright Gleason Jr. entitled Backpack Frame System, currently pending, the entire disclosure of which is incorporated herein by reference.

BACKGROUND OF INVENTION

Backpacks have been used for many years to carry a given load of contents on the back of a user. Modern backpack designs configured to carry moderate to large loads (in terms of weight and/or bulk) usually fall into one of two categories: external frame backpacks and internal frame backpacks. Both internal and external frame backpacks have a waist or hip belt and a yoke. The hip belt is designed to transfer a substantial amount of the weight of the backpack and contents from rigid or semi-rigid supports of the backpack to the hips of the backpack user. The yoke is primarily designed to stabilize the backpack load and more properly position portions of the backpack relative to the user's torso and shoulders. However, the yoke may also transfer a small amount of the weight of the backpack and contents to the user's shoulders, and in certain situations, may alternatively be called on to support the full weight of the backpack and contents without the use of the hip belt.

External frame backpacks typically include rigid, tubular frames (e.g., formed of aluminum or other metals or rigid materials) for supporting the weight of a pack bag. Such external frame backpacks can be particularly useful in securely holding bulky or heavy contents. The frame members of these frames are usually rigidly interconnected by a welded or pinned connection. A load is typically carried inside the pack bag or can be connected directly to the external frame. Pack bags and the like may be connected with the frame by, for instance, stitching a sleeve, loop or pocket formed on the pack bag over the frame members.

One drawback of the rigid frame design is that forces generated by an impact incident on the attached pack bag or the frame itself create stresses that tend to remain concentrated at either (1) the region of impact, (2) in the pack bag itself, or (3) at the associated connection points of the pack bag with the frame. For example, because of the rigid nature and lack of give of the typical external frame under force loading, loads on the pack bag must often generate a high level of tension on the pack bag material before appreciable transferring of the loads to the frame occurs. When an impact is severe, the locations of stress concentration tend to tear or fracture, and because pack bag material is not as strong as the rigid frame material, the bag may rip open and scatter the contents that were held therein.

Some external frame backpacks allow users to attach extra pack bags to the frame as needed. However, these extra bags are often connected via pins or strapping wrapped around the tubular frame members. Such connections are prone to fractures and tearing when the frame is under stress. Another disadvantage of external frame backpacks is the tendency for such packs to be unstable relative to internal frame packs because the load is usually placed laterally farther away from the user's center of gravity, a situation which is exacerbated by the rigidness of the external frame.

Internal frame backpacks generally allow a carried load to better conform to the profile of a user's back so that stresses on the user's body are reduced as compared to load carrying with an external frame backpack. However, the frame components of typical internal frame packs tend to become distorted from their original shape under the weight and shape of the backpack's load. Another disadvantage of internal frame backpacks is that the shape of the pack bag is dictated largely by the shape of the frame. Accordingly, the load side of the backpack often tends to mirror the wearer's back shape which may not be optimum for organizing a load thereon. As a result, internal frame backpacks do not effectively store contents that could otherwise be retained in the backpack. The relationship between the bag and the support members also prevents internal pack bags from being removable and modular. As such, the user is unable to swap a larger pack bag for a pack smaller bag without changing backpacks entirely.

Therefore, current external and internal frame designs lack the ability to form a backpack with modular pack bags or load carriers while also providing a frame structure that conforms well to a user's body profile, efficiently transfers loads to the user's body frame, and is resistant to impact loads incident either directly on the frame or indirectly through components attached to the frame.

SUMMARY OF INVENTION

A backpack frame system is provided that, when combined with pack bags, load carriers, or the like, forms a backpack for hauling various contents on the user's body. The backpack frame system includes a latticework of vertical and horizontal semi-rigid support members, each member contained within and captured between opposite ends of a sleeve which is mounted to a membrane. An adjustable yoke is coupled with the membrane and a hip belt attached to the sleeves of the vertical support members and/or the membrane to enable loads carried by the support members to be transferred to the user's body.

In one aspect of the invention, the sleeves of the horizontal or cross support members are attached with the sleeves of the vertical or upright support members through a flexible connection between abutting portions. This connection allows for increased flexure without permanent deformation or yield of the frame system to properly conform to a user's body profile under loading and absorb impact loads incident upon the support members.

In another aspect of the invention, modular fragmentary pack bags and load carriers may be attached to the backpack frame system. The modular pack bags can be of various sizes, and may include an upper and/or lower spade each configured to fit between one of the cross support members and the membrane in and through a gap therebetween. A connection strap and buckle are preferably provided for attaching the pack bag to the frame system, with each spade stabilizing the load of the pack bag on the frame system and at least the lower spade facilitating the transferring of force loads from the pack bag to the respective cross support member. The load carrier may have an adjustable load shelf formed with an elongated spade and a pair of opposed wings extending generally from lateral sides of a front panel or retainer extending from the load shelf. The elongated spade has lateral flex lines that divide the spade into partitions such that a selectable number of the spade partitions may be slid beneath one or more of the horizontal or cross support members and the remaining spade partitions, if any, utilized along with another section of the load shelf to form a platform for supporting contents on the load carrier. The opposed wings may be used to restrict lateral movement of the contents to maintain the contents on the load carrier platform.

Another aspect of the invention provides a back length yoke adjustment means where hook and loop fasteners are used to secure the yoke to the membrane, and a yoke adjuster sheet or blade breaks the hook and loop attachment for adjusting the vertical position of the yoke relative to the membrane and attached support members. The adjuster sheet is slid into the yoke pocket between the yoke and the membrane to disengage the hook members from the loop members initially at the upper exposed edge of the joint between the hook and loop members. The hook and loop members are freely movable relative to one another while the adjuster sheet is between same. Then the yoke is moved vertically up or down to the proper position for the yoke to use the wearer's shoulders to stabilize the load carried by the frame system. Upon removal of the adjuster sheet, the hook and loop fasteners reengage with one another and secure the yoke in place.

In still another aspect of the invention, the hip belt has a generally diagonal fold seam in each side portion thereof allowing a substantial portion of the hip belt to be folded upwardly generally along the membrane and vertical support members. This folding action significantly reduces the front to rear "thickness" taken up by the backpack. In one arrangement, the hip belt is attached with the sleeves of left and right side outermost vertical support members so that fitting of the hip belt to a user causes such vertical support members to conform generally to the user's body profile.

Many advantages are provided by the backpack frame system and various other components of the invention that form a backpack. The latticework of vertical and horizontal semi-rigid support members provides active stabilizing of loads attached to the frame system. Quick adjustment of the backpack for user's of various sizes is provided by the integral yoke adjustment means. Prior art backpacks often require, for yoke adjustment, the user to repeatedly don and remove the pack while performing these adjustments until a comfortable fit is obtained. The folding hip belt reduces the thickness of the pack frame for ease of storage in space-restricted environments. Furthermore, the backpack frame system may, in one arrangement, possess interface capability with existing military-type ALICE back packs. With use of the modular fragmentary pack bags, load carriers and various strapping provided on the backpack frame system, the backpack can effectively carry what would be traditionally considered awkwardly shaped loads, such as bulky rigid containers, exceedingly long or wide objects, or human casualties.

BRIEF DESCRIPTION OF DRAWINGS

In the accompanying drawings which form a part of this specification and are to be read in conjunction therewith. Like reference numerals are used to indicate like parts in the various views:

FIG. 3*a* is a top plan view of the base frame showing the flexible connection between one horizontal support member and a pair of vertical support members, and FIG. 3*b* is a perspective view of the base frame under a torsional load created by a force impact on the backpack frame system;

FIG. 4*a* is a perspective view of a backpack formed by the backpack frame system and a pack bag showing the base frame under a bending load created by a force impact on the backpack frame system, and FIG. 4*b* is another view of the backpack of FIG. 4*a* showing loading of the base frame upon impact with a surface;

DETAILED DESCRIPTION

Figure 1:
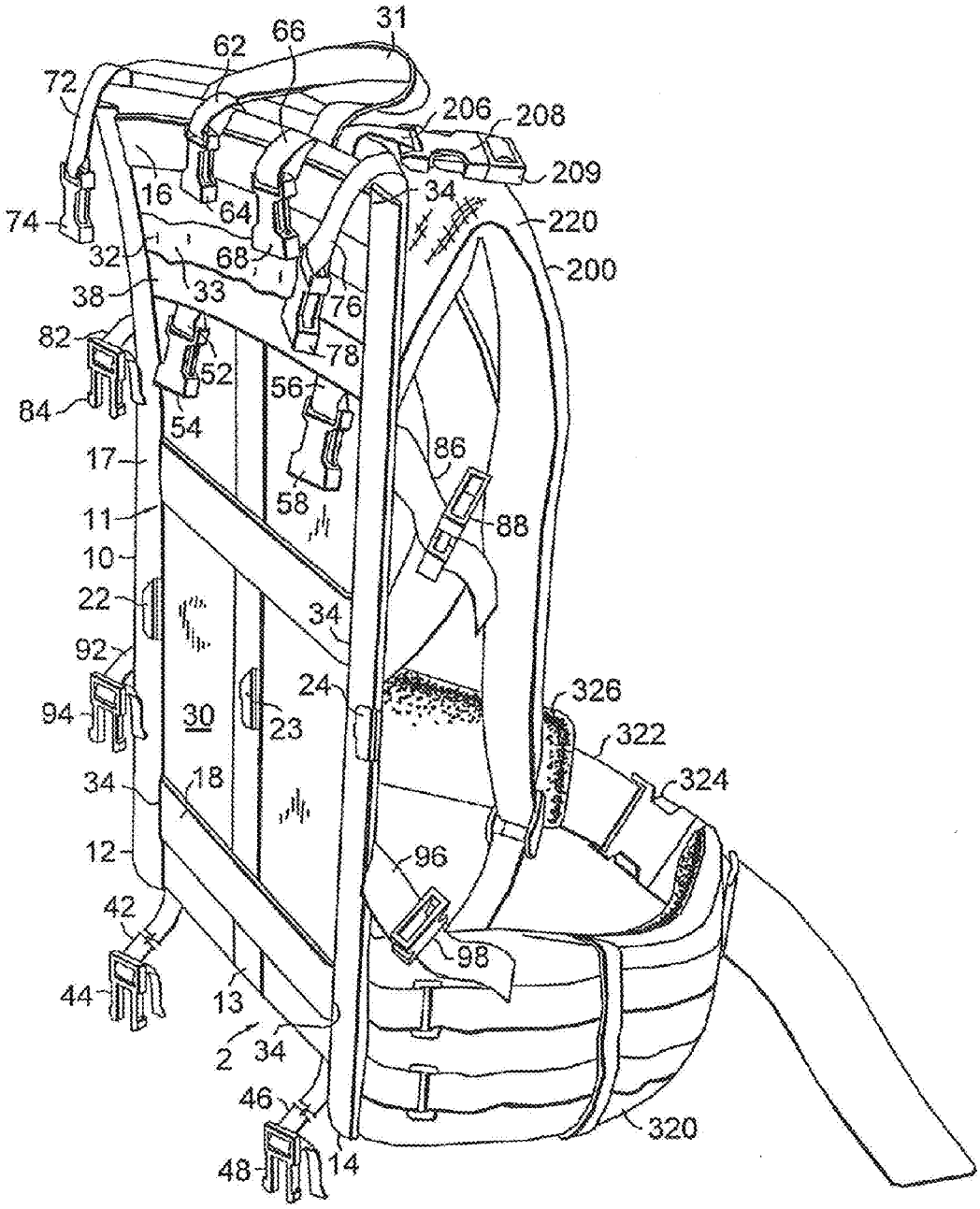
FIG. 1 is a perspective view of a backpack frame system in accordance with one embodiment of the present invention.

Referring now to the FIGURES in greater detail, and initially to FIG. 1, a backpack frame system ("frame system") is designated by the reference numeral 10. The frame system 10 includes a base frame assembly 11 coupled with a hip belt 320 and a shoulder strap assembly 201 with shoulder straps 220 and yoke 200 to form a backpack that may be worn by a user to transport various contents. The description of pack frame system 10 will use terms such as vertical and horizontal. These terms are used to describe the parts when the pack frame system 10 is in its normal upright orientation.

Figure 2:
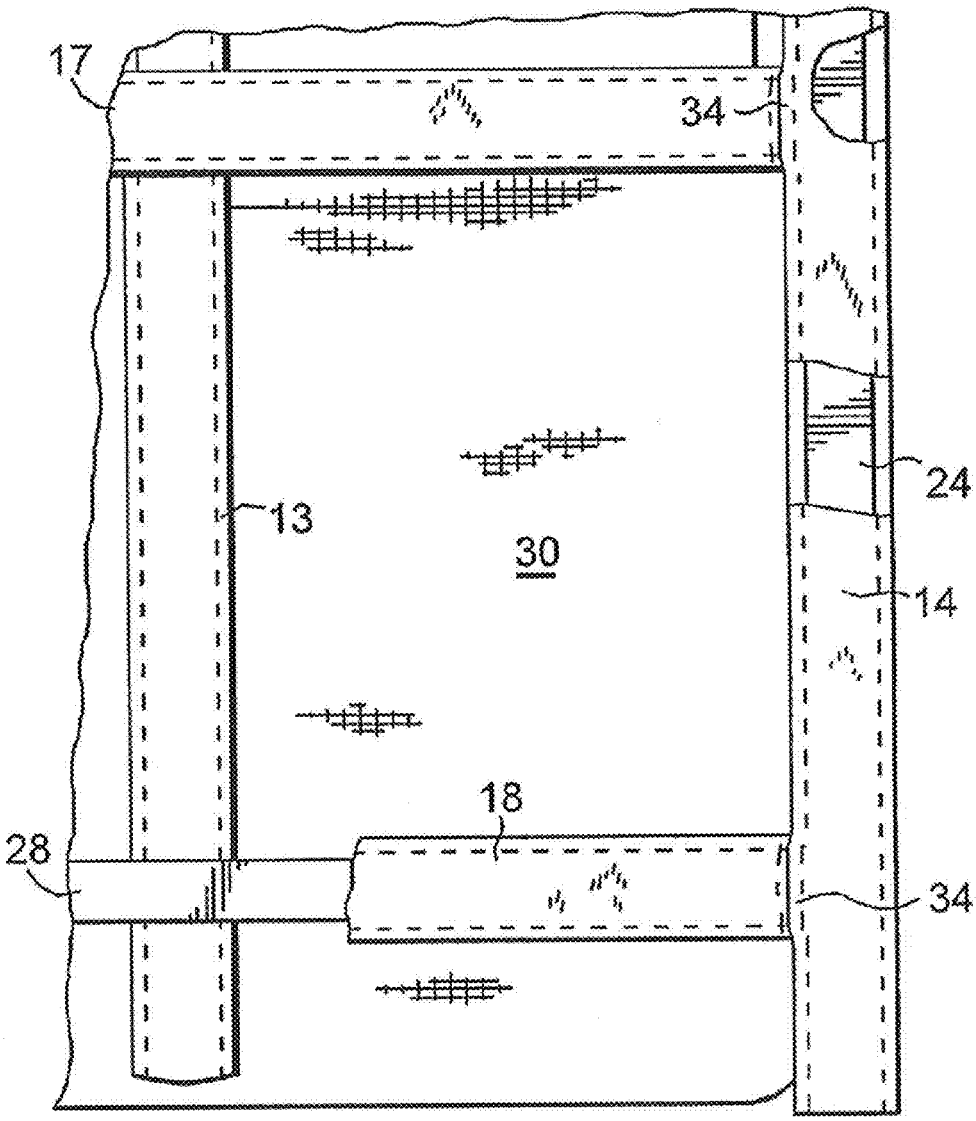
FIG. 2 is a partial front elevational view taken generally at the location designated by the indicator 2 in FIG. 1 showing a portion of the latticework of horizontal and vertical support members attached to the membrane webbing and with portions of the sleeves cut away to reveal the support members.

With additional reference to FIGS. 2, 3(*a*)(*b*), 4(*a*)(*b*) and 5, the base frame 11 includes a latticework of horizontally and vertically oriented semi-rigid support members or frame stays 22, 23, 24, 26, 27, and 28 that are encased in sleeves 12, 13, 14, 16, 17, and 18, respectively, and held in place by a membrane 30 forming various generally rectangular arrays of stays. Each of the frame sleeves 12, 13, 14, 16, 17, and 18 are preferably attached with at least one of the other frame sleeves 12, 13, 14, 16, 17, and 18 and/or with the membrane 30 to form the structure of the base frame 11. Preferably, the frame sleeves 12, 13, 14, 16, 17 and 18 have closed ends capturing a respective stay in a respective pocket defined therein.

In one embodiment, base frame 11 includes a left vertical frame stay 22, housed within a sleeve 12, a center vertical frame stay 23, housed within a sleeve 13, and a right vertical frame stay 24, housed within a sleeve 14. The vertical frame stays 22, 23 and 24 are positioned by the sleeves 12, 13 and 14 (or "vertical stay sleeves" 12, 13 and 14) to be generally parallel with one another and achieve the vertical orientation when the frame system 10 is in the upright position shown in FIG. 1. The stays 22, 24 are outermost stays. Center vertical stay 23 is positioned generally along a vertical centerline of the membrane 30 between and equidistant from sleeves 12 and 14. Base frame 11 further includes an upper cross or horizontal frame stay 26, housed within a sleeve 16, an intermediate cross or horizontal frame stay 27, housed within a sleeve 17, and a lower cross or horizontal frame stay 28, housed within a sleeve 18. The horizontal frame stays 26, 27, and 28 are positioned by the sleeves 16, 17 and 18 (or "horizontal frame sleeves" 16, 17 and 18) to be spaced from and generally parallel with one another, extending laterally between left and right outermost vertical frame stays 22 and 24 and over the center vertical frame stay 23 to achieve the horizontal orientation when the frame system 10 is in the upright position. As shown in FIG. 1, sleeve 16 associated with upper horizontal frame stay 26 may extend laterally between the vertical stay sleeves 12, 14 to opposing points on the sleeves 12, 14 proximal to and slightly below the upper ends of sleeves 12, 14, sleeve 17 associated with middle horizontal frame stay 27 may extend between approximately the vertical midpoints of vertical stay sleeves 12, 14, and sleeve 18 associated with lower horizontal frame stay 28 extends laterally between the vertical stay sleeves 12, 14 to opposing points on the sleeves 12, 14 located several inches above the lower ends of sleeves 12 and 14. The stays 22, 23, 24, 26, 27 and 28 form one or more polygonal and preferably generally rectangular arrays with at least some of the stays having abutting end portions. However, it should be understood that the specific positioning of the vertical and horizontal frame stays 22, 23, 24, 26, 27 and 28 described herein, as well as the number of stays, represents one preferred arrangement that can be implemented to form the base frame 11. However, other configurations for the stays are contemplated by the teachings herein.

The frame stays 22, 23, 24, 26, 27, and 28 may, in one exemplary configuration, be constructed of ⅝-inch wide by ⅛-inch thick carbon fiber reinforced fiberglass and are semi-rigid and elastically deformable. However, other stiffening materials that are strong and rigid enough to carry backpack loads while maintaining a degree of resiliency may be used to form the frame stays 22, 23, 24, 26, 27, and 28. These stiffening materials may include certain types of metals, laminated wood, plastics, composites, and the like. Frame sleeves 12, 13, 14, 16, 17, and 18 are preferably constructed of a durable and preferably fabric-like material, such as nylon strapping or polyester strapping similar to the material frequently used in automobile seatbelts. For instance, each sleeve 12, 13, 14, 16, 17, and 18, may be constructed using two straps that are sewn or welded together along the lateral edges, creating a hollow tube or pocket for housing the respective frame stay 22, 23, 24, 26, 27, and 28. Membrane 30 is flexible and preferably formed with 1000 denier Cordura® nylon or a similarly strong synthetic material, but may also be made of cloth, leather, or another similarly strong and flexible membrane. The membrane material may be knit, woven or felted fabric or a continuous film. It may also be made of metal fabric such as that used in cut resistant gloves. If a fabric, it will have inter-connected fibers or strands.

Each of the vertical stay sleeves 12, 13, and 14 is held in position by membrane 30. Membrane 30 may take on a generally rectangular shape to provide a mounting surface for the vertical stay sleeves 12, 13 and 14. Preferably, membrane 30 extends laterally across the vertical stay sleeves 12, 13 and 14, and extends vertically across the horizontal stay sleeves 16, 17 and 18 with upper and lower portions of the membrane 30 extending above the uppermost horizontal sleeve 16 and below the lowermost horizontal sleeve 18. Vertical stay sleeves 12, 13, and 14 are sewn down or otherwise attached generally along their peripheral edges and preferably an inside edge to membrane 30. Horizontal stay sleeves 16, 17 and 18 may be directly attached on opposed lateral ends thereof with the left and right vertical stay sleeves 12, 14, and optionally, also with the membrane 30. As shown in FIG. 3*a*, the attachment between horizontal stay sleeves 16, 17 and 18 and the left and right vertical stay sleeves 12, 14 forms, in one arrangement, a respective flexible seam 34. Flexible seam 34 may be formed by broadly sewing down the fabric-like material of horizontal stay sleeves 16, 17, and 18 to the material of the left and right vertical stay sleeves 12, 14. Alternatively, flexible seam 34 may be formed by welding, adhesives, or other methods known in the art. Flexible seam 34 provides increased flexibility to the base frame 11 to absorb impact loads incident thereon, and when the frame system 10 is worn on a user's back, flexible seam 34 allows the base frame 11 to better conform to the profile of the user's torso, creating a more comfortable fit. The connections between the abutting portions of the cross and vertical stay sleeves form flexible joints.

By only attaching each horizontal stay sleeves 16, 17 and 18 on their respective lateral ends, a gap is formed between the stay sleeves 16, 17 and 18 and the membrane 30 that may be used to couple or otherwise secure various items to the base frame 11, as will be more fully explained below. Furthermore, by only affixing the lateral ends of the horizontal stay sleeves 16, 17 and 18 with the vertical stay sleeves 12, 13, and 14, the horizontal frame stays 26, 27, and 28 are able to possess improved bending and energy absorbing properties when an impact load is incident on the base frame 11.

In an alternative embodiment, membrane 30, frame sleeves 12, 13, 14, 16, 17, and 18, and flexible seams 34 may be formed from a synthetic fabric-like material with a thermoplastic urethane or other coating or a laminated construction, enabling the fabric to be molded in selected locations, thereby increasing manufacturing efficiency.

Figure 5:
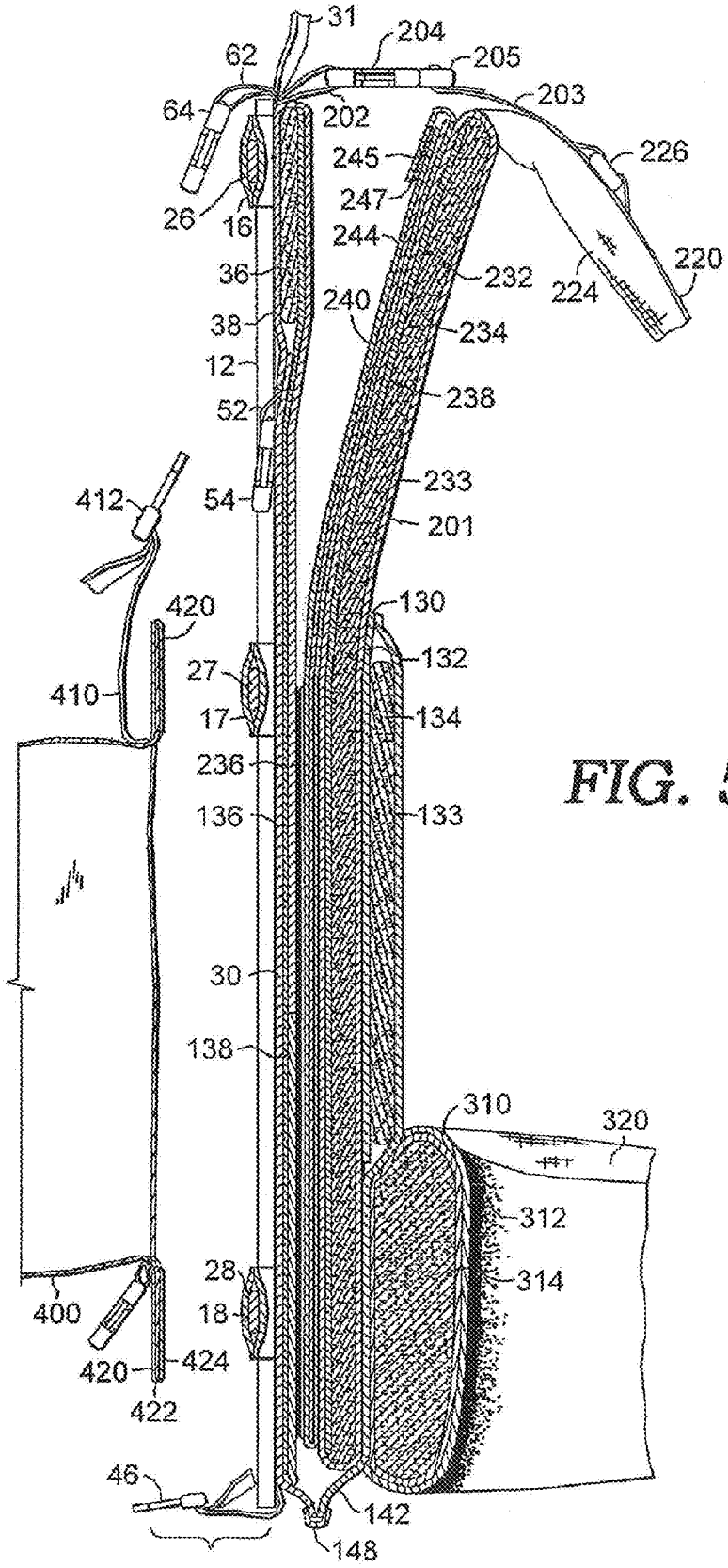
FIG. 5 is a cross-section of the backpack frame system of FIG. 1 taken from a side elevation with the pack bag detached from the frame system.

With reference to FIGS. 1 and 5, a rectangular pad 36 is encased by a pad cover 38 extending from membrane 30. Pad 36 is generally disposed between upper regions of vertical sleeves 12 and 14, extending laterally from an edge of one vertical stay sleeve 12 or 14 to the other vertical stay sleeve 12 or 14. Pad 36 may be constructed from a sheet of flexible padding material such as plastic foam. Pad cover 38 may be constructed using a fabric material similar to that of membrane 30, or preferably as depicted in FIG. 5, may be formed by extending membrane 30 around pad 36 forming a pouch. In one exemplary arrangement, pad 36 and pad cover 38 extend downwardly about 4 or 5 inches from a point near the top of base frame 11 covering the upper end of vertical stay sleeve 13, such that a portion of the sleeve 13 is between membrane 30 and pad 36.

Pad 36 with pad cover 38 provides support for multiple buckles and straps used for fastening and stabilizing a load to frame system 10. As shown in FIG. 1, daisy chain strap 32 can be attached to the surface of pad cover 38. Daisy chain strap 32 may be formed by anchoring (e.g., by sewing) nylon strapping at spaced intervals to a surface such as pad cover 38, thereby forming a series of loops 33 in the strapping. Additional gear may be attached via these loops 33. As further shown in FIGS. 1 and 5, looped buckle straps 52 and 56, which have fitted thereon buckles 54 and 58, are attached to the lower edge of pad cover 38, optionally between membrane 30 and pad cover 38. Buckles 54 and 58 are used for attaching loads as described in further detail below.

With continued reference to FIGS. 1 and 5, a series of looped buckle straps 202 and 206 and buckles 204 and 208 are attached to the base frame 11 near the upper edge of membrane 30 (i.e., pad cover 38). Buckle straps 202 and 206, each formed from a loop of strapping, have fitted thereon buckles 204 and 208, and loops 202 and 206 are anchored to membrane 30 in such a way as to properly align the lateral position of the buckles 204 and 208 with the shoulder strap assembly 201 which includes yoke 200 and a pair of shoulder straps 220. Buckles 204 and 208 (through mating buckles 205 and 209) are used for connecting or tethering shoulder straps 220 to pack frame system 10 for selectively arranging shoulder straps 220 and yoke 200 with respect to upper regions of the base frame 11 to properly support loads secured on the pack frame system 10, as will be further described below. Additional looped buckle straps 62 and 66 are attached to the base frame 11 near the upper edge of membrane 30 at positions spaced from the attachment of the straps 202, 206 with the membrane 30. Buckles 64 and 68 are fitted onto the buckle straps 62 and 66. Adjacent to the buckle straps 202 and 206 are buckle straps 72 and 76, which are likewise attached to the base frame 11 near the upper edge of membrane 30. Buckle straps 72 and 76 have fitted thereon buckles 74 and 78. Buckle straps 72 and 76 are also generally longer than buckle straps 62 and 66. As shown in FIG. 1, a loop 31 positioned at the top of frame system 10 and preferably attached to membrane 30 may be used to handle or hang frame system 10 when pack frame system 10 is not positioned on a user's back.

Vertically oriented straps 42 and 46, FIG. 1, are attached to the base frame 11 near the lower edge of the membrane 30 and proximal to lower ends of vertical stay sleeves 12 and 14. Straps 42 and 46 are threaded through buckles 44 and 48, which may be adjusted to various positions along straps 42 and 46. Buckles 44 and 48 can be coupled together with either buckles 64 and 68, or buckles 74 and 78, to secure objects between straps 42 and 46 and base frame 11. Preferably, straps 42 and 46 are long enough so that when coupled with buckles 64 and 68, or buckles 74 and 78, straps 42 and 46 extend across a variety of objects that are contemplated for attachment to the frame system 10. Buckles 44, 48, 64, 68, 74 and 78 may be formed using releasable male and female buckle connectors.

A first set of horizontally oriented straps 86 and 96, FIG. 1, are positioned along the right side of base frame 11 and are attached to vertical stay sleeve 14. A second set of horizontally oriented straps 82 and 92 are positioned along the left side of base frame 11 and are attached to vertical stay sleeve 12. Straps 82 and 86 are attached with the respective outermost vertical stay sleeves 12 and 14 generally at the same height as one other and approximately midway between horizontal stay sleeves 16 and 17. Likewise, straps 92 and 96 are similarly attached with the respective vertical stay sleeves 12 and 14 at the same height with respect to each other and approximately midway between horizontal stay sleeves 17 and 18.

Straps 82 and 86 are threaded through buckles 84 and 88, which may be adjusted to various positions along straps 82 and 86. Buckles 84 and 88 can be coupled together and may be formed using releasable male and female buckle connectors. Similarly buckles 94 and 98 can be coupled together and may be formed using releasable male and female buckle connectors. Coupling together of buckles 84 and 94 with corresponding buckles 88 and 98 secures objects between straps 82, 86, 92 and 96 and base frame 11. Preferably, straps 82, 86, 92 and 96 are long enough so that when coupled with 94, 88, 84 and 98, straps 82, 86, 92 and 96 extend across a variety of objects that are contemplated for attachment to the frame system 10.

Horizontal straps 82, 86, 92 and 96 and vertical straps 42, 46 52, 56, 62, 66, 72 and 76 may be formed from durable fabric-like material (e.g., similar to the frame sleeves 12, 13, 14, 16, 17, and 18), and may be anchored with the base frame 11 by sewing the straps to the respective base frame component (i.e., membrane and/or frame sleeves) or by other means. They may also be removably attached as with hook and loop fasteners. As previously described, horizontal straps 82, 86, 92 and 96 and corresponding buckles 84, 88, 94 and 98, as well as vertical straps 42, 46, 52, 56, 62, 66, 72 and 76 and corresponding buckles 44, 48, 54, 58, 64, 68, 74 and 78 can be used for attaching a load to frame system 10. Additionally, the aforementioned buckles and straps can be used for compressing loads (i.e., objects) attached to the frame system 10. When used for load compression, the base frame 11, substantially through stays 22, 23, 24, 26, 27 and 28, transfers tension more uniformly throughout frame system 10 than either traditional external frame or internal frame backpacks. More specifically, straps 42, 46, 52, 56, 62, 66, 72, 76, 82, 86, 92 and 96 transfer this tension more directly to the horizontal and vertical frame stays 22, 23, 24, 26, 27, and 28, which are designed to flex slightly under load to increase tension distribution throughout base frame 11. Membrane 30 also reduces the occurrence of stress concentrations in the frame system 10 under load by distributing the tension from the straps across a broad area of material to all of the frame stays 22, 23, 24, 26, 27, and 28 within the frame sleeves 12, 13, 14, 16, 17, and 18.

As an analogy, the base frame 11 acts in a similar way to a bow and arrow, and further promotes stability of the load, because the load, when attached to or compressed by one or more straps 82 and 86, 92 and 96, 42 and 72, or 46 and 76, is always actively supported and drawn close to frame system 10 and the user's center of gravity by the flexing frame stays.

The attachment of horizontal straps 82, 86, 92 and 96 are vertical straps 42, 46, 52, 56, 62, 66, 72 and 76 with the base frame 11 may be achieved by durable fabric-like material.

Flexible seam 34 may be formed broadly by sewing down the material of horizontal stay sleeves 16, 17, and 18 to the material of the left and right vertical stay sleeves 12, 14. Alternatively, flexible seam 34 may be formed by welding, adhesives, or other methods known in the art.

Attention is now directed to FIGS. 5 through 9. The present invention further includes multiple systems for attaching a load on pack frame system 10. A load may be carried by pack frame system 10 using a fragmentary pack bag 400, load carrier 500, or by coupling the load directly to the frame system 10. Each of these will be discussed in further detail below.

A fragmentary pack bag 400 can be coupled to back pack frame and support system 10 using one or more spades 420 and buckles 412, which can be coupled together with one or more of buckles 54, 58, 64, 68, 74, 78, 44, 48, 84, 88, 94, and 98 and in a preferred embodiment are formed using releasable male and female buckle connectors. Alternatively, instead of buckles or in addition to buckles, lashing tabs (not shown) attached to bag 400 may be used to couple bag 400 to frame system 10 by threading one or more of straps 82, 86, 92, 96, 42 and 46 through the tabs. A lashing tab can be constructed using a short piece of strapping or a sheet of plastic that is sewn or otherwise attached to bag 400 along two opposite ends forming a loop similar to a belt loop on a pair of pants. More than one bag 400 may be mounted to the frame system 10 and may be mounted side to side and/or in superposed relationship.

As shown in FIG. 5, spade 420 is a semi-rigid tongue attached along one edge to bag 400 and in the preferred embodiment comprises a spade support 422 enveloped by a spade cover 424 that is attached to bag 400. Spade support 422 may be constructed from a semi-rigid bar such as plastic sheeting, polymeric foam, fiberglass, or similar material having a thickness of about 1/32 inch or more. Spade cover 424 can be constructed from a durable fabric material such as what may be used to construct bag 400 or membrane 30. Alternatively, spade support 422 may be sewn, welded, or otherwise anchored along one edge directly to bag 400 without a cover.

Figure 6:
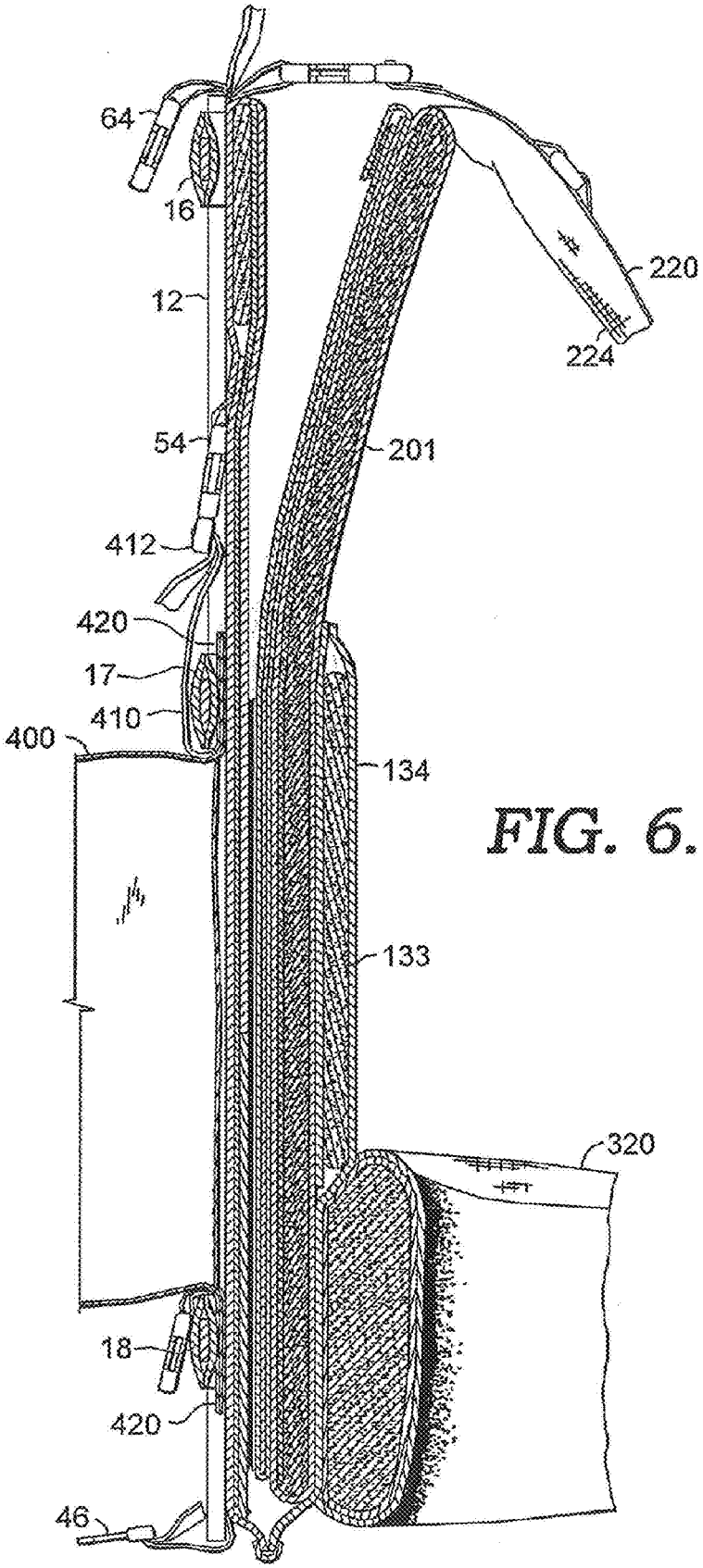
FIG. 6 shows the backpack frame system depicted in FIG. 5 from a side elevation with the pack bag attached to the frame system to form a backpack.

With further reference to FIG. 6, fragmentary pack bag 400 connects to frame system 10 by first positioning each spade 420 between membrane 30 and one of horizontal sleeves 16, 17, and 18. Next, as shown in FIG. 6, buckle 412 is coupled together with mating buckle 54. Each buckle 412 on a pack bag 400 is coupled with a mating buckle from one of buckle 54, 58, 64, 68, 74, 78, 44, 48, 84, 88, 94, and 98. Alternatively, as described above, lashing tabs may be employed.

Pack bags 400 can come in a variety of shapes and sizes and can be made from durable fabric, molded plastic, metal or any similar material. Pack bags 400 can be similar to the pack bags on conventional backpacks and preferably include a main compartment with an access opening (not shown) that may be secured by a zipper or other fastening means. The bag 400 may further include a number of sub compartments, pockets, flaps, and partitions as known in the art. Existing containers such as other packs, ammunition boxes, camera bags, or virtually any suitably sized container can be modified to become a pack bag 400 by attaching one or more spades 420 and buckles 412 or lashing tabs.

A pack bag 400, such as the one partially depicted in FIGS. 5 and 6 can also be positioned higher up on frame system 10 by positioning spades 420 between membrane 30 and horizontal sleeves 16 and 17. Additional pack bags 400 with spades 420 may be coupled to frame system 10, in a similar fashion as described above, as needed. Thus bags 400 can be considered modular enabling a user to customize their load carrying capability by only attaching the number and type bags 400 that are needed. For example, a hiker preparing for a weekend hike may only couple one medium-sized bag 400, large enough to hold a weekend's worth of clothing and gear, to frame system 10. Similarly, a hiker preparing for a longer trip may couple a larger bag 400 or multiple medium-sized bags 400 to pack frame system 10.

Figure 7:
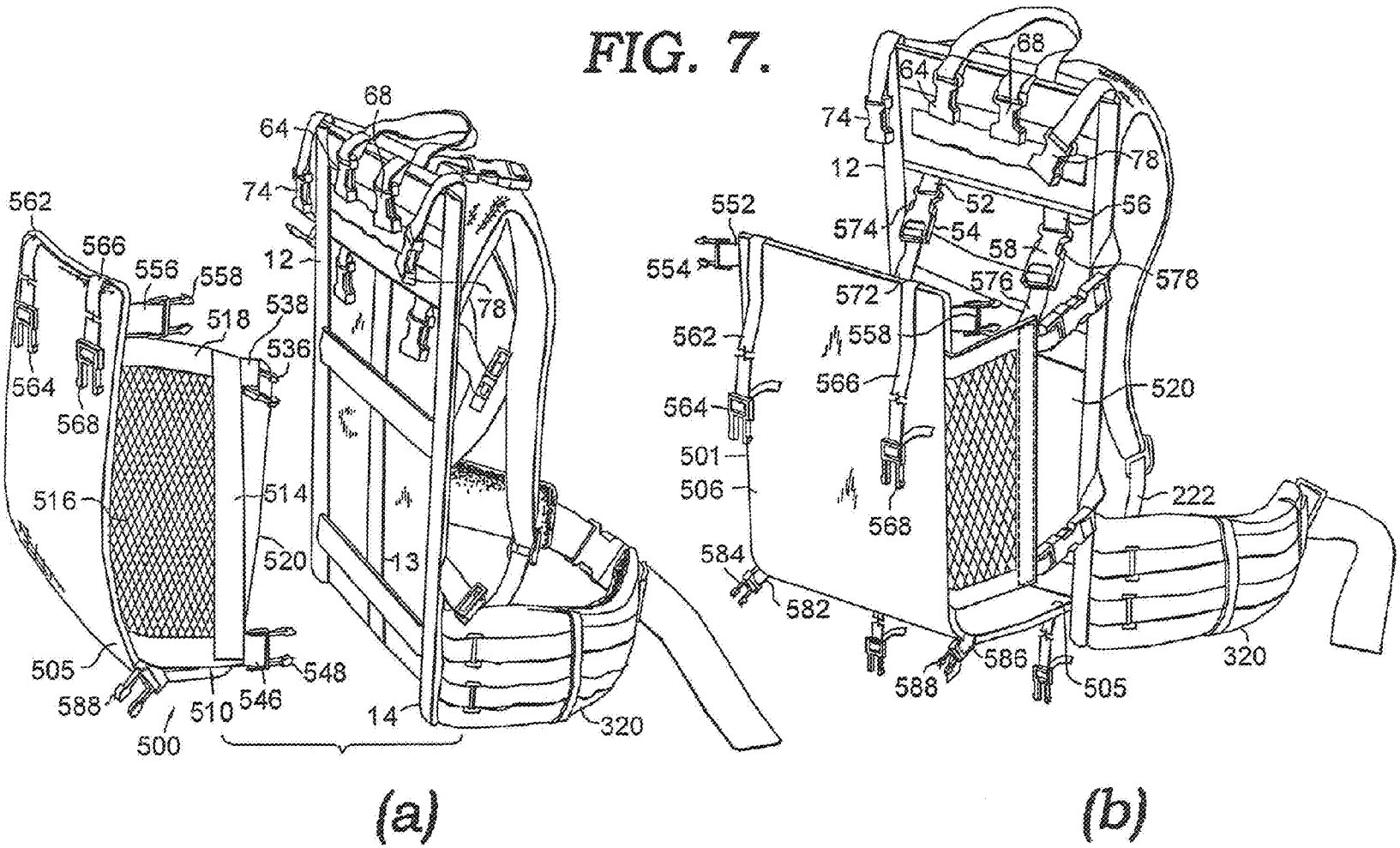
FIG. 7*a* is a perspective view of the backpack frame system of FIG. 1 with the load carrier detached from the frame system.
FIG. 7*b* is a perspective view of the backpack frame system of FIG. 1 with the load carrier attached to the frame system to form a backpack.
Figure 8:
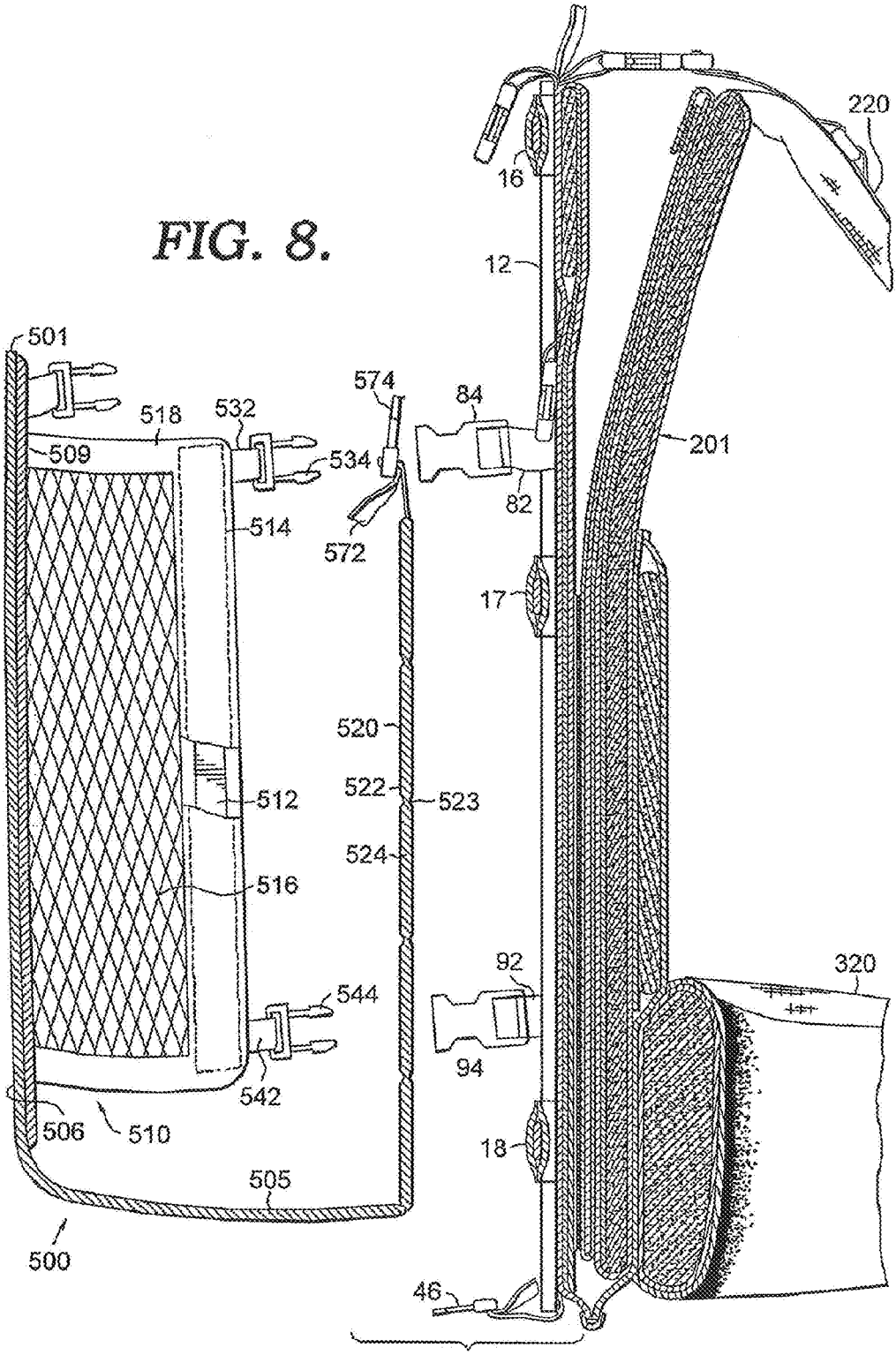
FIG. 8 is a cross-section of the backpack frame system of FIG. 1 taken from a side elevation with the load carrier detached from the frame system.
Figure 9:
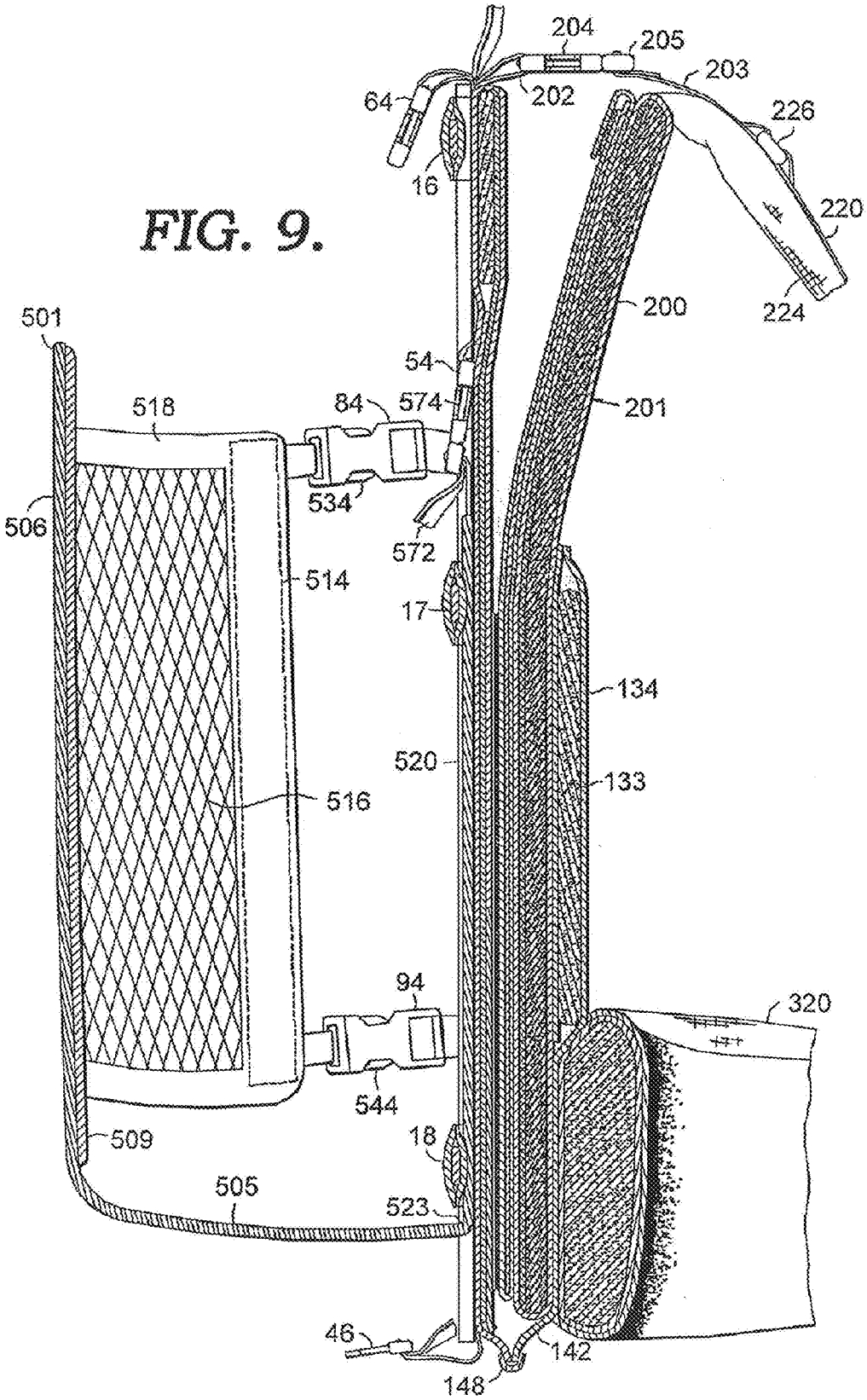
FIG. 9 shows the backpack frame system depicted in FIG. 8 from a side elevation with the load carrier attached to the frame system to form a backpack.

As shown in FIGS. 7-9 a load carrier 500 provides another means for carrying a load with frame system 10. Load carrier 500 includes support 501 and an adjustable load shelf 505 connected to an elongated spade 520, and a pair of wings 510. Preferably load shelf 505 and spade 520 are made from an outer shell liner 522 housing structural spade support 524. Preferably, spade support 524 is made from a flexible material such as plastic sheeting, composites, fiberglass, carbon fiber composite, metal or plastic foam and shell liner 522 is made of nylon or a similarly strong synthetic material, but may also be made from cloth, leather, or other materials known in the art. Alternatively, shell liner 522 and spade support 524 may be formed from a laminated synthetic material and molded into a unitary structure.

Wings 510 are attached, along each side of load shelf 505. Wings 510 support the load and hold the load within support 501 including a shelf 505 and restraint 506. As shown, the support 501 is generally horizontal and restraint 506 is generally vertical. With further reference to FIG. 8, preferably wings 510 are constructed preferably using a tacky and perforated membrane 516, which is attached along each side of the restraint 506 of load support 501. Membrane 516 is framed by strapping material 518 such as nylon strapping, which is sewn around the edge of membrane 516 and provides additional strength to wings 510. The outer edges of wings 510 include a wing sleeve 514 housing a wing support bar 512. Wing sleeve 514 may be constructed in a manner, similar to frame sleeves 12, 13, 14, 16, 17, or 18, using a durable fabric-like material such as nylon strapping. In one embodiment, sleeves 514 may be constructed using two straps that are sewn or welded together along the edges, creating a hollow shell for housing the wing support bar 512. Wing support bar 512 is semi-rigid and may be constructed using a strip of carbon fiber reinforced fiberglass, but could also be constructed of metal, laminated wood, or other stiffening material as described above.

An additional membrane 509 of preferably tacky and perforated material is attached along the interior of restraint 506 of shelf 505. Membranes 509 and 516 help to grip the load and keep it stationary within load carrier 500. Wing support bars 512 pull membrane 516 uniformly across load further promoting stability. When not needed, wings 510 can be folded onto restraint 506 and secured together using buckles 534 and 538 coupled together with buckles 544 and 548 respectively. The load carrier 500, when not in use, may be positioned and stored between the stays 16, 17, 18 and membrane 30 while still allowing use of bags 400.

Load carrier 500 further includes various buckles and compression straps for attaching load carrier 500 to frame system 10 in multiple configurations and for stabilizing and compressing the load. Horizontal attachment buckles 554, 558, 584, 588, FIG. 7, are attached along the left and right sides of load shelf 505. Horizontal attachment buckles 534 and 544 are attached to left wing 510 and horizontal attachment buckles 538 and 548 attached to right wing 510. Vertical compression straps 562 and 566 are attached to the end of load shelf 505 and are threaded through a pair of adjustable buckles 564 and 568. These buckles can be used to attach compression straps 562 and 568 to the top of frame system 10 by coupling buckles 564 and 568 with buckles 74 and 78 or buckles 64 and 68. Similarly, straps 572 and 576 are attached to the end of spade 520 and are threaded through a pair of adjustable buckles 574 and 578. Preferably buckles 574 and 578 couple together with pack frame buckles 56 and 58, when attaching load carrier to frame system 10, but buckles 574 and 578 may also couple together with buckles 64 and 68. The load carrier 500 forms a generally upwardly opening receptacle.

Spade 520 is coupled to pack frame system 10 in the same manner as pack bag spade 420, by being positioned between membrane webbing 30 and at least one of horizontal sleeves 16, 17, or 18 and coupled together with buckles 574 and 578 to buckles 56 and 58 or buckles 64 and 68. Elongated spade 520 is substantially longer than the preferred embodiment of pack bag spades 420. Thus, spade 520 may be positioned behind more than one horizontal frame sleeve 16, 17, and 18, as is shown in FIG. 9, where spade 520 is positioned behind horizontal stay sleeves 17 and 18. Elongated spade 520 includes one or more flex lines 523 enabling spade 520 to flex horizontally along flex lines 523. Flex lines 523 may be formed by sewing shell liner through spade support 524 or by interrupting spade support 524 along flex lines 523. Flex lines 523 allow spade 520 to be inserted incrementally behind horizontal sleeves 16, 17 and 18, enabling a user to configure various sizes and heights of load shelf 505. Specifically, a flex line 523 is positioned along the lower edge of the lowest horizontal frame sleeve 16, 17, or 18 that is being employed to couple load carrier 500 to frame system 10. Thus, for instance load shelf 505 can be extended to a maximum length by positioning the flex line 523, closest to the end of spade 520 that is not connected to load shelf 505, along the lower edge of horizontal sleeve 17 or 18. The length of load shelf 505 can be reduced by positioning the cross flex line 523 farthest from the free end of spade 520 along the lower edge of horizontal sleeve 17 or 18, as is shown in FIG. 9. Buckles 574 and 578 can slide away from spade 520 along straps 572 and 576, enabling buckles 574 and 578 to connect with frame buckles 54 and 58 or 64 and 68.

In addition to spade 520, load carrier 500 can be further coupled to pack frame system 10 by horizontal attachment buckles 554, 558, 584, 588, 534, 538, 544, and 548. Horizontal buckles 554, 584, 534 and 544 are located along the left side of load carrier 500 and are designed to couple together with one or both of pack frame buckles 84 and 94. Similarly, horizontal buckles 558, 588, 538, and 548 are located along the right side of load carrier 500 and are designed to couple together with one or both of pack frame buckles 88 and 98. For example, as depicted in FIG. 7, along the right side of load carrier 500, buckles 538 and 548 are coupled to frame system 10 buckles 88 and 98 respectively. Buckles 534 and 544 can be similarly coupled to pack frame buckles 84 and 94 (not shown). Buckle 538 could also be connected to pack frame buckle 98 and buckle 534 could be connected to frame buckle 94. Such a configuration would extend load shelf 505 below frame system 10 thereby allowing a taller load item to be more easily transported.

Figure 11:
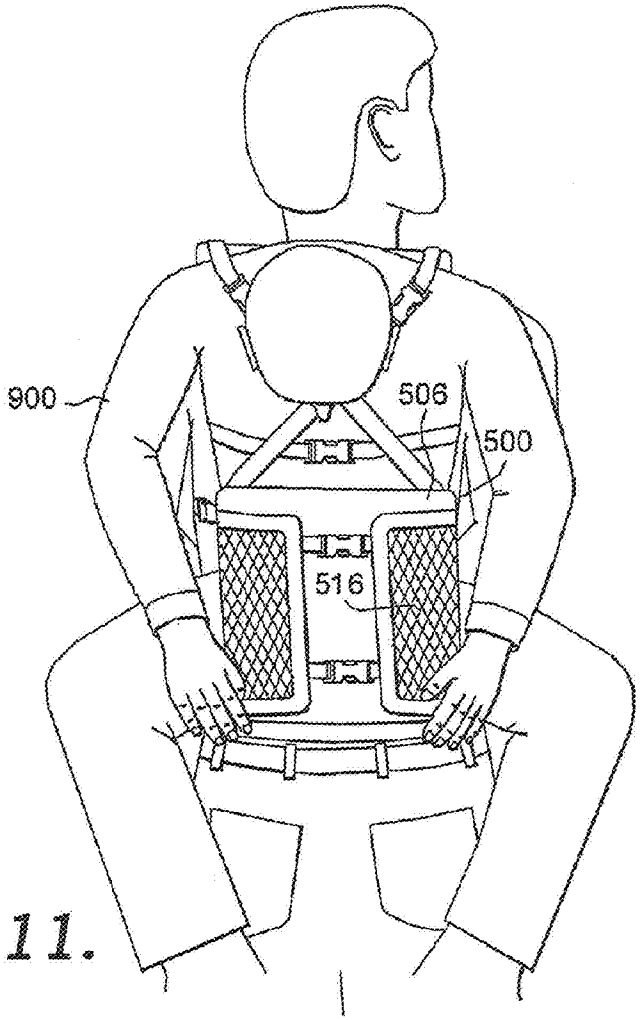
FIG. 11 shows the backpack frame system and load carrier depicted in FIG. 10 configured for transporting a casualty.

As shown in FIG. 11, one of the uses for load carrier 500 is for transporting casualties. In this configuration of load carrier 500, compression straps 562 and 566 are preferably crossed over the chest of victim 900 so that buckle 568 couples together with buckle 74 and buckle 564 couples together with buckle 78. Load shelf 505 forms a seat for victim 900, and wings 510 are folded together and secured by coupling buckles 554 with 558 and 544 with 548. Wing support bars 512 provide additional support to victim 900. Preferably, horizontal compression straps 82 and 86 are positioned horizontally across the chest of victim 900, and are connected together via buckles 84 and 86.

Load carrier 500 is primarily intended for awkwardly shaped loads, large loads unable to fit in pack bags 400, loads including other bags without attached spades 420, or human casualties. However, virtually any load of reasonable weight, capable of fitting inside the opening receptacle formed by load shelf 505, wings 510 and frame system 10, can be carried using load carrier 500.

Another system of the present invention for connecting a load to frame system 10 is direct connection using horizontal frame sleeves, connection buckles and compression straps. A load may be buckled, lashed, tied or strapped directly to pack frame system 10 using frame system 10 elements describe above. In the preferred embodiment, pack frame system 10 is designed to be compatible for interfacing with military-style ALICE-type top loading bags. Soldiers commonly use such bags. The ALICE bag can slip over the top of frame system 10 and be secured to frame system 10 using the horizontal and vertical compression straps 42, 46, 82, 86, 92, and 96.

As discussed above, the novel pack frame design comprising semi-rigid stays attached via frame sleeves to a flexible membrane 30 enables frame system 10 to flex within a certain range and still maintain its overall shape and rigidity with respect to the load and the person carrying the load. This flexibility provides many advantages over conventional pack frames. As seen in FIG. 4(*a*), the included angle A can expand or contract up to about 8° without damage to the frame system. Flexing beyond about 8° then involves the membrane 30 to absorb load or impact. The membrane 30 can stretch generally diagonally between opposite corners of the frame assembly 11 during certain types of loading. One advantage is that pack frame system 10 may conform to users of different sizes by flexing vertical frame stays 22 and 23, housed in frame sleeves 12 and 14, about seam 34, as shown in FIG. 3(*a*). For example, frame system 10 can flex inwardly and wrap around a skinnier person, or flex outwardly and backwardly accommodating a person of larger size.

Another advantage is that the load side of frame system 10 is substantially flat. As will be seen later, the user side of the frame will optimally conform to the shape of the user once the yoke is properly adjusted and the flat load is not compromised. A flat frame provides an easier surface for attaching loads and takes up less space than conventional pack frames. Further, the network of flexible frame stays and compression straps, as described above, pull attached loads close to frame system 10 and flatten out the loads. This action keeps the weight of the load closer to the users center of gravity thereby promoting stability and reducing user fatigue by enabling a user to walk more upright and not bent forward.

Another advantage of the novel design is that frame system 10 is well suited for extremely rugged operation. Frame system 10 is impact resistant and can respond to external forces that may cause conventional external or internal frame packs to fracture or tear. One situation likely to impart these impacts occurs during troop deployment when a soldier's backpack may be thrown or kicked from a moving vehicle such as a truck or helicopter. As shown in FIGS. 3(*b*) and 4, frame system 10 can twist, flex, and absorb the sudden shock of impact because frame stays 22, 23, 24, 26, 27, and 28, housed within sleeves 12, 13, 14, 16, 17, and 18, are not rigidly connected, but can move and flex independently, relative to each other. Additionally, as described above, pack bags 400 and load carrier 500 are not rigidly attached to frame system 10, as typically occurs with conventional packs. Thus under a sudden impact the connection strapping and frame system 10 can absorb the shock and not the bag 400, load carrier 500, or bag connection point. Furthermore, the one or more horizontal stays 16, 17 and 18 used to couple pack bag 400 or load carrier 500 to frame system 10, can momentarily flex outwardly away from frame system 10, further absorbing the forces of impact.

As discussed above, frame system 10 includes a hip belt assembly 320 and a yoke 200. Hip belt 320 includes a lumbar pad 310, hip belt straps 322 and buckle 324, and hip pads 326. Hip belt 320 is constructed generally according to conventional high-end hip belts on the market, but may include adjustable hip pad 326 with functionality as known in the art. Hip belt 320 is secured to frame system 10 along the outer edges of vertical stay sleeves 12 and 14. This enables the weight of a load to be directed to hip belt 320 and then further to lumbar pad 310 and hip pads 326. Lumbar pad 310 is constricted using lumbar padding 314 surrounded by a lumbar pad liner 312. Preferably lumbar pad 310 extends across the width of the users lower back, thereby increasing surface contact for better transfer of the load weight to the user's skeletal system.

Figure 14:
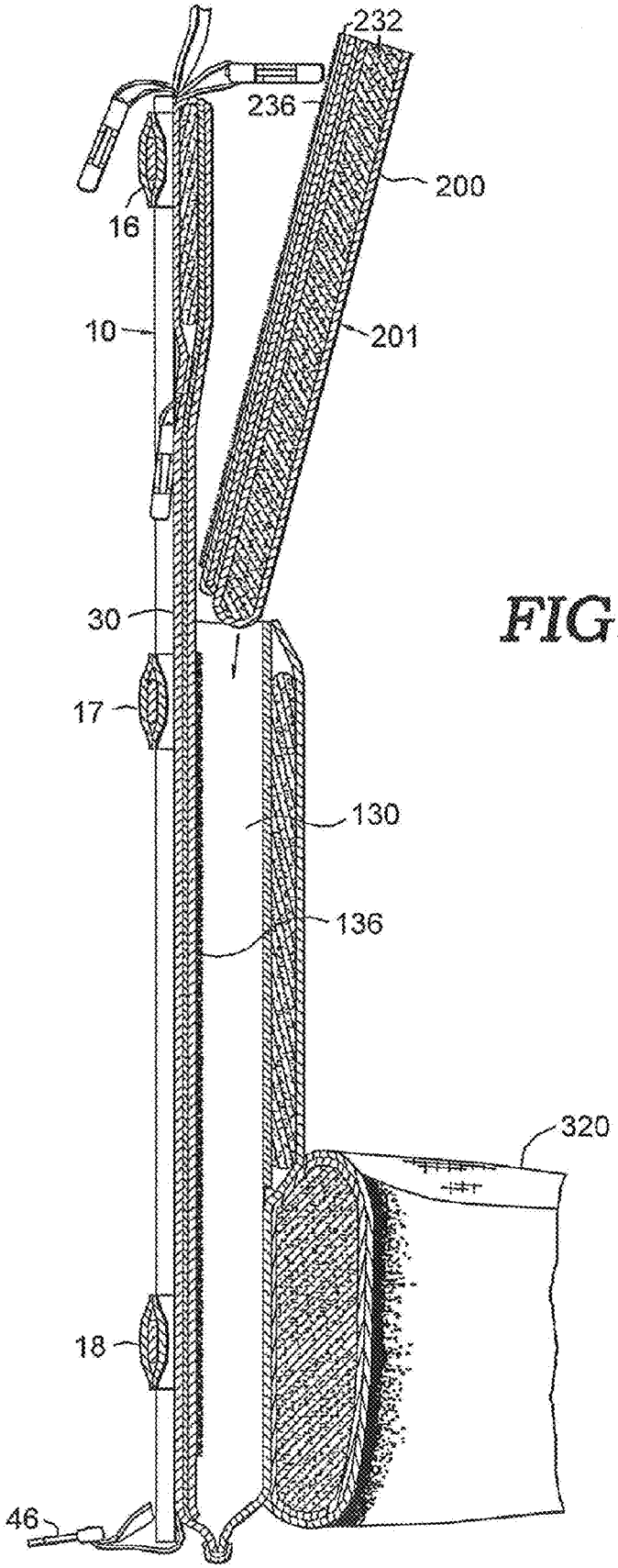
FIG. 14 is a cross-section of the backpack frame system of FIG. 1 taken from a side elevation showing the direction of insertion of the yoke into the yoke pocket for removably attaching the yoke with the remainder of the backpack frame system.

The shoulder strap assembly 201 including yoke 200 serves as the interface between the user and frame system 10 and shoulder straps 220, optional sternum strap 229 and layers of various frame support components, and padding. With reference to FIGS. 5 and 14, yoke 200 is constructed with an inner mesh lining 233 that attaches along the edges to an outer lining 232. Within linings 233 and 232 are a yoke support sheet 238, which may be made from a thin sheet of flexible material such as plastic, and a pad 234, which is substantially thicker than linings 232 and 233 and yoke support sheet 238. Preferably pad 234 is made from durable foam rubber or an open-celled polymeric foam that works with mesh liner 233 to facilitate the transport of a user's perspiration away from the users body. A support bar sleeve or pocket member 244 is vertically oriented and attached to the of yoke 200. Sleeve 244 can be constructed, in a manner similar to frame sleeves 12, 13, 14, 16, 17, and 18, from a durable fabric like material such as nylon strapping, and can in one embodiment be constructed using two straps that are sewn or welded together along the edges, creating a hollow shell or pocket-like member for housing the a support bar 240. In another embodiment, the sleeve 244 is constructed of a flexible material, such as 1000 denier Cordura® nylon or a similarly strong synthetic material like the membrane 30. The sleeve 244 material may also be knit, woven, a felted fabric, a continuous film, or have interconnected fibers or strands.

Figure 19:
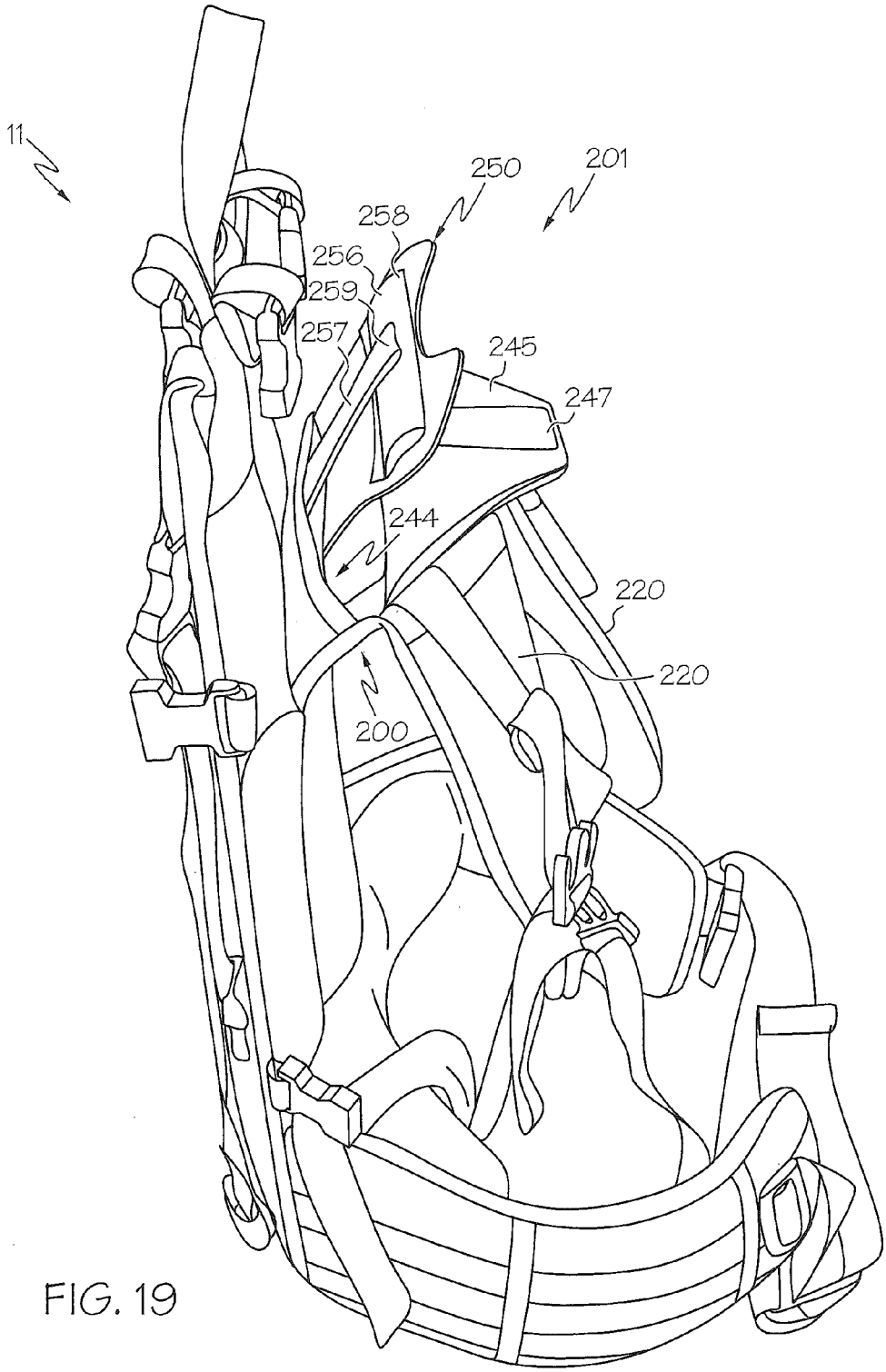
FIG. 19 is a perspective view of a backpack frame system showing the adjuster sheet being inserted into a sleeve attached to the yoke so that the adjuster sheet may operate as a supporting element.

Yoke support bar 240 is housed within sleeve 244 and runs from near the top of yoke 200 to near the bottom. Preferably bar 240 is constructed using a strong lightweight and pliable material such as aluminum that can be permanently formed and still resiliently deformable, which can be generally shaped to complement the typical curve of the spinal cord of the user. In one embodiment, support bar 240 removably placed within sleeve 244 and a flap 245 positioned at the top end of sleeve 244, and secured by a VELCRO® patch 247, can be opened to remove support bar 240 from sleeve 244. In another embodiment, support bar can be formed integrally and permanently with yoke 200. In yet another embodiment, the yoke 200 does not include a support bar 240 or yoke support sheet 238, but rather, as discussed in more detail below, the adjuster sheet 250 or 600 functions to provide the support otherwise provided by the support bar 240 and yoke support sheet 238 when not operating to separate VELCRO® hook or loop patches 136 and 236. In such an embodiment, the adjuster sheet 250 or 600 can be housed within sleeve 244. FIG. 19 illustrates the adjuster sheet 250 partially placed within sleeve 244. Once the adjuster sheet 250 is pushed further into and fully placed within the sleeve 244, flap 245 can be closed.

Figure 10:
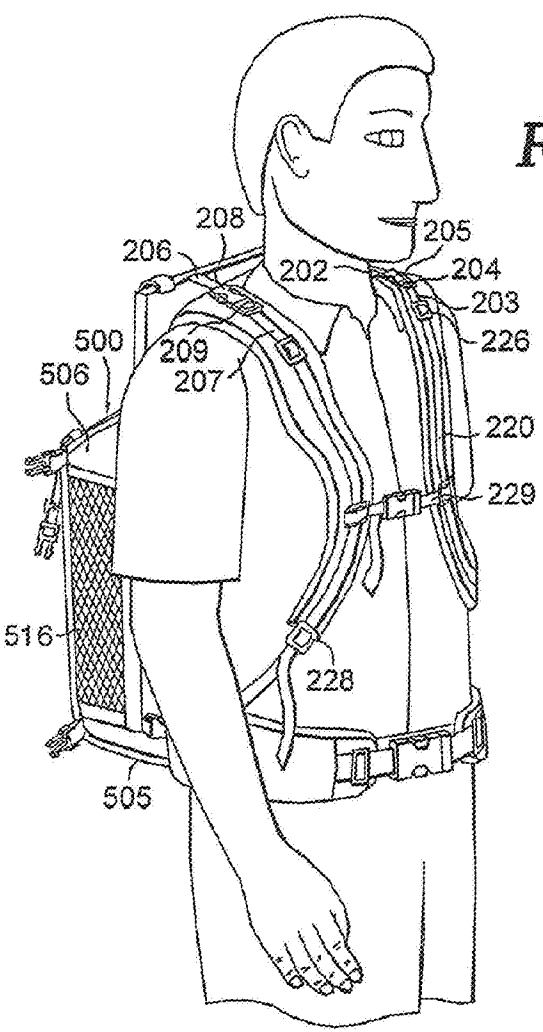
FIG. 10 illustrates the backpack frame system of FIG. 1 having the load carrier attached therewith and fitter onto a user.

With additional reference to FIG. 10, the upper ends of shoulder straps 220 are attached to the right and left sides of the top of yoke 200 and are angled outward away from center to accommodate the users neck and shoulders. Shoulder pads 224 are anchored to shoulder straps 220 by stitching, welding, VELCRO®, or other means of fastening known in the art. In a preferred embodiment, shoulder pads are attached directly to yoke 200, but in other embodiments are made removable by only attaching them to shoulder straps 220. Shoulder straps 220 include a sliding buckle 226, which connects to straps 203 and 207. Straps 203 and 207 extend upward over shoulder straps 220 to buckles 205 and 209, which are coupled to buckles 204 and 208, thereby anchoring shoulder straps 220 and yoke 200 to the top of frame system 10. The length and tension of straps 203 and 207 can be adjusted to the user's comfort using sliding buckle 226 and adjustable buckles 205 and 209. Preferably shoulder straps 220 are coupled to frame system 10 such that straps 202 and 206 are generally horizontal with respect to the ground. This configuration provides for improved stability and reduces shoulder fatigue.

The lower ends of shoulder straps 220 are each attached to an adjustable buckle 228. A pair of lower shoulder straps 222 are threaded through buckles 228 and attached to the interior edges of vertical stay sleeves 12 and 14, approximately 3 to 4 inches from the bottom of frame system 10. By pulling straps 222, a user can tighten the shoulder straps 220 on the user's shoulders. It should be noted that the majority of the load weight is intended to be carried primarily on the user's hips, and not on the users shoulders. Shoulder straps 220 are primarily intended to stabilize the pack and keep the load close to the users center of gravity, where the load weight can be more efficiently transferred to the user's skeletal system.

An important feature of the invention is that the yoke 200 is completely removable from frame system 10 and also can be quickly adjusted using the adjuster sheet 250. As best depicted in FIGS. 5 and 14, frame system 10 further includes a pocket 130 for housing yoke 200. Pocket 130 is comprised of an inner lining 132 made from a durable fabric such as nylon, a pad 134 similar to yoke pad 234, and a mesh lining 133 also similar to yoke mesh lining 233. Linings 133 and 132 are attached along their edges forming a shell around pad 133. The interior wall of pocket 130 adjacent to frame system 10 includes a pocket frame sheet 138, made from a thin sheet of flexible material such as plastic or fabric and is sewn down or otherwise attached along its edges to frame system 10. A VELCRO® hook or loop patch 136 is also attached to the surface of the interior wall of pocket 130 adjacent to frame system 10 and partly covering pocket frame sheet 138. A corresponding patch 236 of VELCRO® is attached to yoke liner 232, such that the patches 136 and 236 can attach together, thereby anchoring yoke 200 to frame system 10 when yoke 200 is placed in pocket 130, as shown in FIG. 14. The upper portion of yoke 200 is free of attachment to frame system 10.

Figure 12:
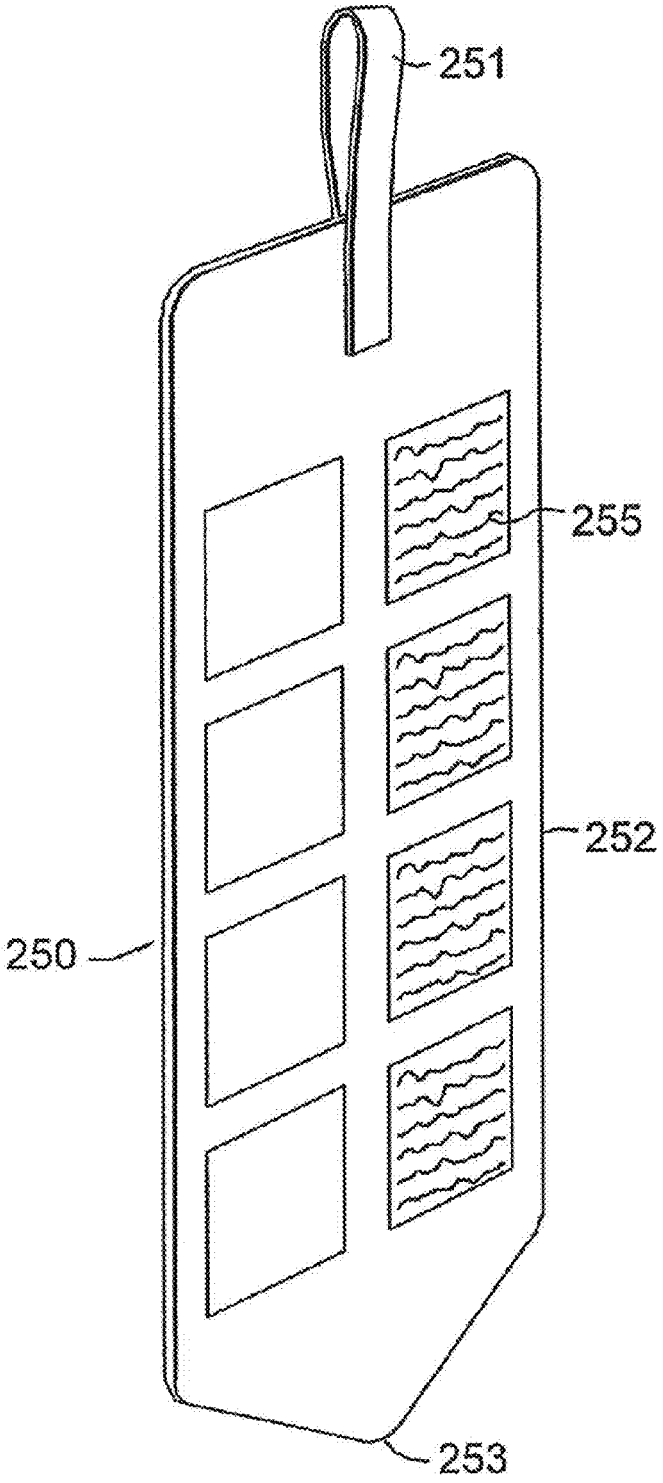
FIG. 12 is a perspective view of the yoke adjuster sheet.
Figure 13:
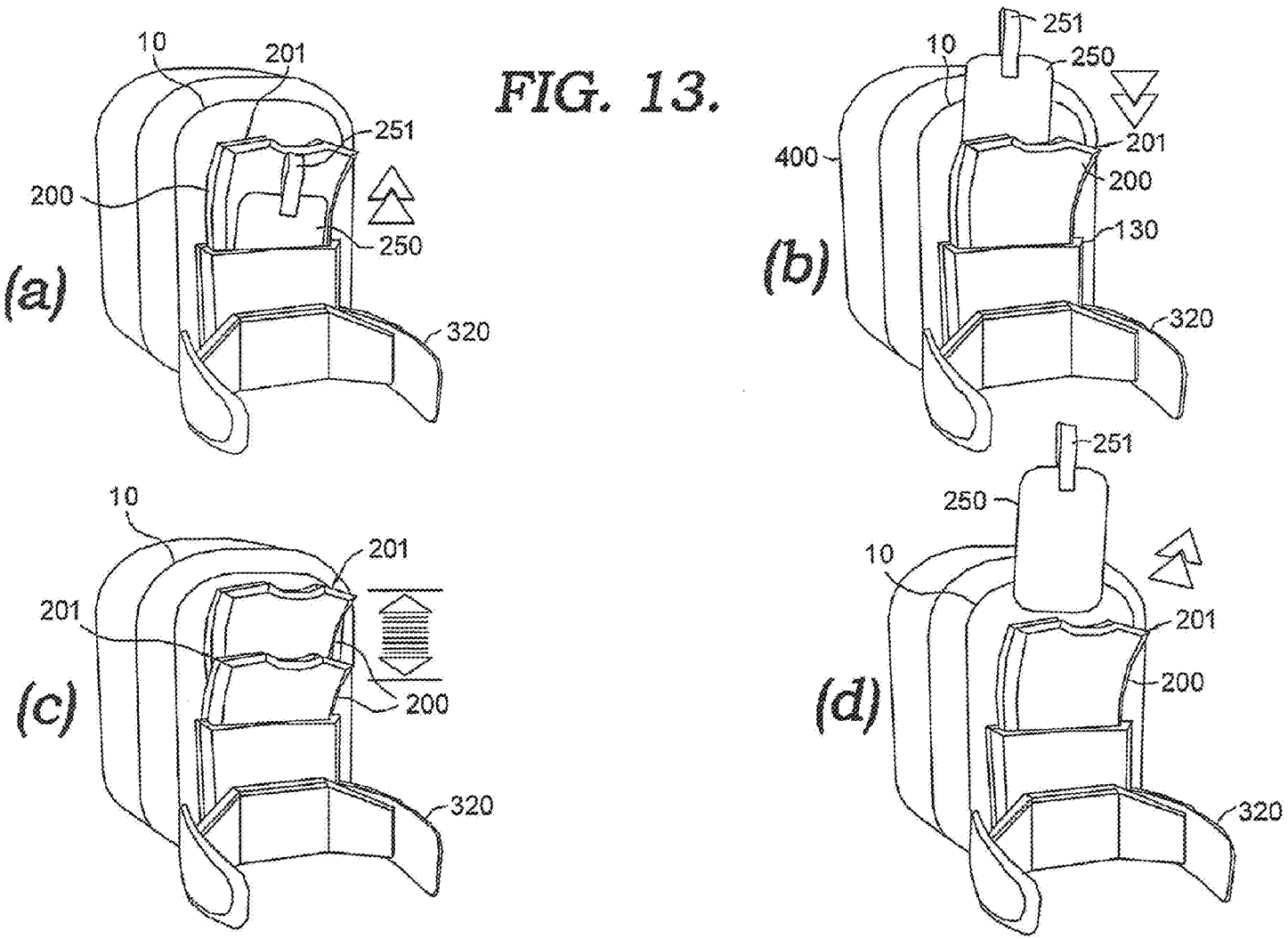
FIGS. 13*a-d* illustrates the sequence of steps for adjusting the position of the yoke utilizing the yoke adjuster sheet.

As shown in FIGS. 12, 13 and 14, yoke 200 can be adjusted to varying heights, to accommodate users of different heights, by adjusting the amount of yoke 200 that extends into pocket 130. This adjustment is facilitated using adjuster sheet 250. Preferably adjuster sheet 250 is constructed of a thin flexible but semi-rigid plastic sheeting, or similarly thin material. Adjuster sheet 250 may also be constructed of a metallic material, such as aluminum or the like. When adjuster sheet 250 is constructed of plastic sheeting, it may optionally include support strips 256 and 257 made of a metallic material attached thereto in order to provide an increased amount of rigidity. This is particularly important in the embodiment where the adjuster sheet 250 serves as both an adjuster and a supporting element. As illustrated in the embodiment shown in FIG. 19, the support strips 256 and 257 may be configured in a "T-shaped" arrangement with one strip horizontally-oriented across the top of the adjuster sheet 250 and a second strip vertically-oriented along the center region of the adjuster sheet 250. The support strips 256 and 257 may be contained within sleeves 258 and 259 that are sewn or otherwise attached to the adjuster sheet 250.

As demonstrated in the embodiment shown in FIG. 12, adjuster sheet 250 can have a tapered end 253, a handle 251, blade 252 and contains instructions 255 printed upon its surface describing how to perform adjustments. Loop handle 251 can be constructed using a piece of nylon strapping.

In operation, adjuster sheet 250 is inserted into pocket 130 between yoke 200 and frame system 10, thereby interrupting the VELCRO® attachment of patches 136 and 236. Upon breaking this attachment, yoke 200 is free to move upwardly and downwardly, as shown in FIG. 13. Preferably, the user inserts adjuster sheet 250 while wearing frame system 10 and proceeds to adjust yoke 200 to a comfortable position. When a comfortable position is found, the user removes adjuster sheet 250 allowing VELCRO® patches 136 and 236 to attach together, thereby anchoring the position of-yoke 200 with respect to frame system 10. When not operating as an adjuster, adjuster sheet 250 can be stored in pocket 130 or sleeve 244, or in an alternative embodiment, yoke lining 232 can have a closable opening enabling yoke support sheet 238 to be removed and used as adjuster sheet 250. Thus, the adjuster sheet 250 can become a supporting element of the yoke 200 when not operating as an adjuster.

The advantageous features provided by the adjustment system of the present invention enables soldiers to quickly reconfigure their packs to fit comfortably over body armor. This armor can typically weigh as much as 24 pounds. In the preferred embodiment, a soldier can position yoke 200, using adjuster sheet 250, such that lumbar pad 310 supports much of the weight of the soldier's body armor.

Figure 17:
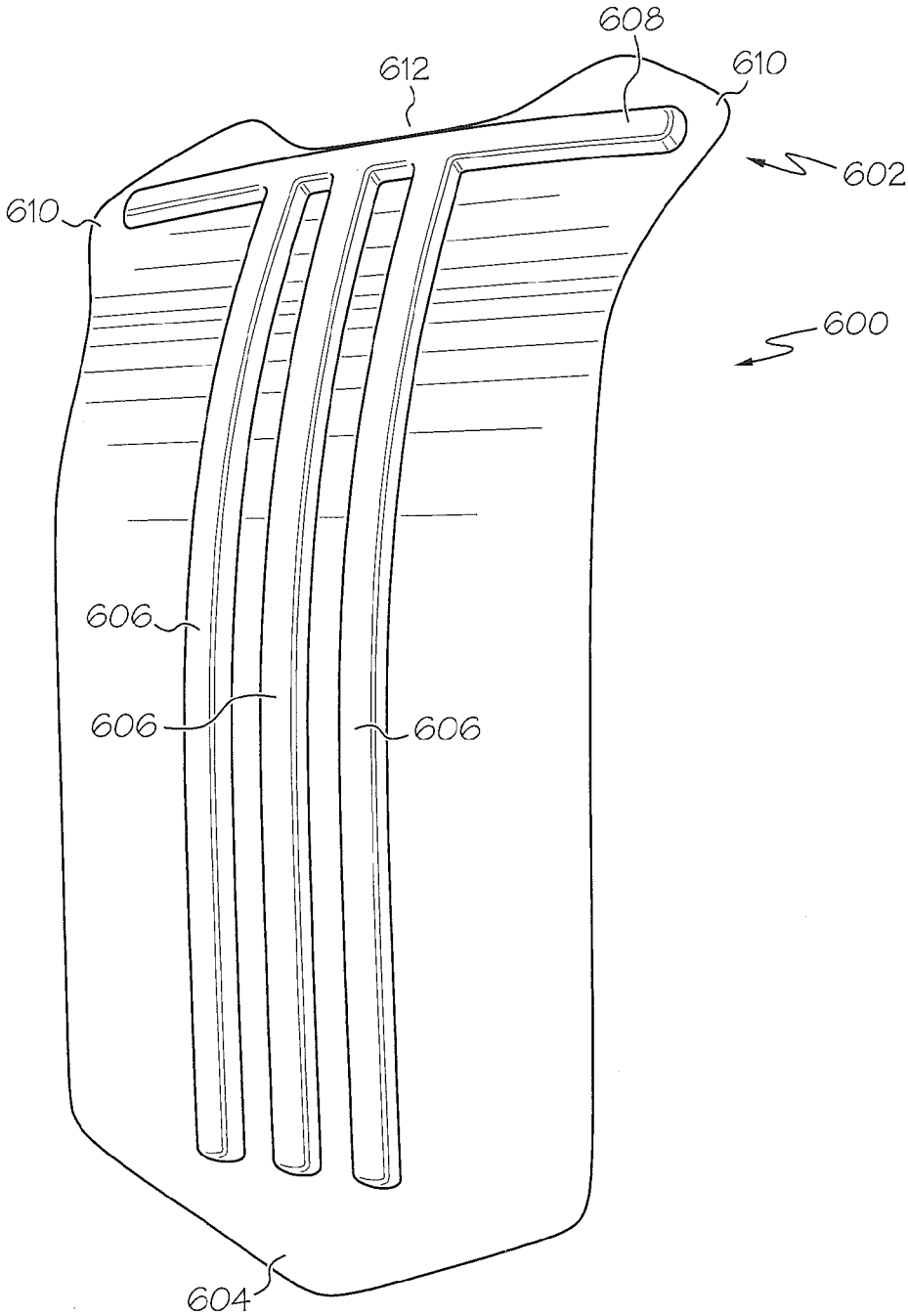
FIG. 17 is a rear perspective view of an alternative the yoke adjuster sheet.
Figure 18:
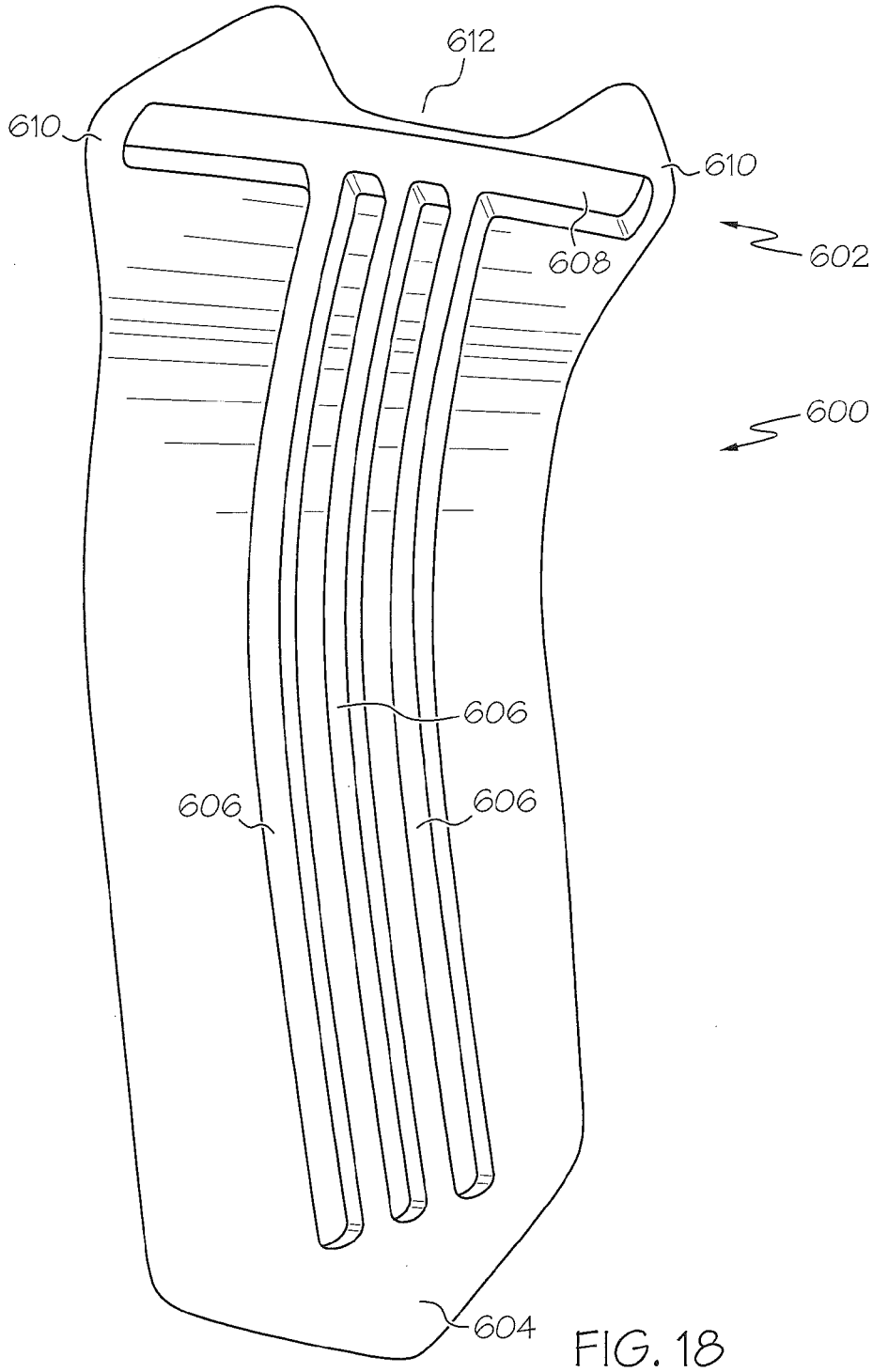
FIG. 18 is a front perspective view of an alternative the yoke adjuster sheet.

An alternative embodiment of an adjuster sheet 600 is shown in FIGS. 17 and 18. Like adjuster sheet 250, adjuster sheet 600 may operate both as an adjuster and as a supporting element of yoke 200.

The adjuster sheet 600 includes a top end 602 and a tapered bottom end 604. It can be curved to reflect the shape of a user's back. As illustrated, the adjuster sheet 600 has a plurality of vertically-oriented reinforcing ribs 606 proximate the sheet's 600 center region and a horizontally-oriented reinforcing rib 608 proximate the sheet's top end 602. The "T-shaped" orientation of the reinforcing ribs 606 and 608 allows the adjuster sheet 600 to be rigid and stiff in some aspects, yet flexible and deformable in other aspects. The vertical ribs 606, which run parallel to the user's spine, provide bending rigidity about a vertical plane, yet allow torsional flexibility about a vertical axis. The rigidity provided by the vertical ribs 606 facilitates in distributing the weight of the system 10 and its contents about a user's back. The torsional flexibility provided by the vertical ribs 606 reflects the way a user's back and spine can rotate. The horizontal rib 608, which runs across the width of a user's shoulders, provides lateral bending rigidity about the adjuster sheet's top end 602.

The adjuster sheet 600 can be formed of a laminated composite material using an infusion molding or stamping process. The laminated composite material forming the adjuster sheet 600 is comprised of a plurality of layers of a fiber material impregnated with a resin. In the manufacturing process, the fiber material used is typically in the form of tape-like strips. Manufacturing the adjuster sheet 600 from tape-like strips allows a relatively larger amount of fiber and resin to be selectively placed where strength and rigidity are most critical and a relatively smaller amount of fiber and resin to be selectively placed where strength and rigidity are less critical, thereby saving material and decreasing the adjuster sheet's 600 weight. For example, the adjuster sheet 600 may include an increased number of fiber layers in its center and top regions and a fewer number of fiber layers near its edge and lower regions. In one embodiment, the resin infused into the fiber is a mixture containing polyethylene terephthalate and polyurethane.

Like adjuster sheet 250 described above, adjuster sheet 600 can also be stored in pocket 130 or sleeve 244 when not in use, thereby enabling the adjuster sheet 600 to become a supporting element of yoke 200 when not operating as an adjuster. In such an embodiment, yoke 200 will not include a support bar 240 and/or a yoke support sleeve 238, as adjuster sheet 600 will operate as the yoke's 200 supporting element. When used as a supporting element, the top end 602 of the adjuster sheet 600 is located proximate the user's upper back region. Extensions 610 protruding outwardly from the adjuster sheet's top end 602 provide support and distribute weight about the user's shoulders. The top end 602 also includes a recessed area 612 for accommodating the user's neck.

As described, adjuster sheet 600 is made of a single piece of material and does not include the use of metallic support strips in order to provide strength and rigidity. This is beneficial in that it reduces the adjuster sheet's 600 overall weight. It is also beneficial in that the sheet 600 can be used in connection with systems 10 carrying with electronic equipment, as metallic materials will sometimes distort the signals being transmitted from and received by certain types of electronic equipment.

Figure 15:
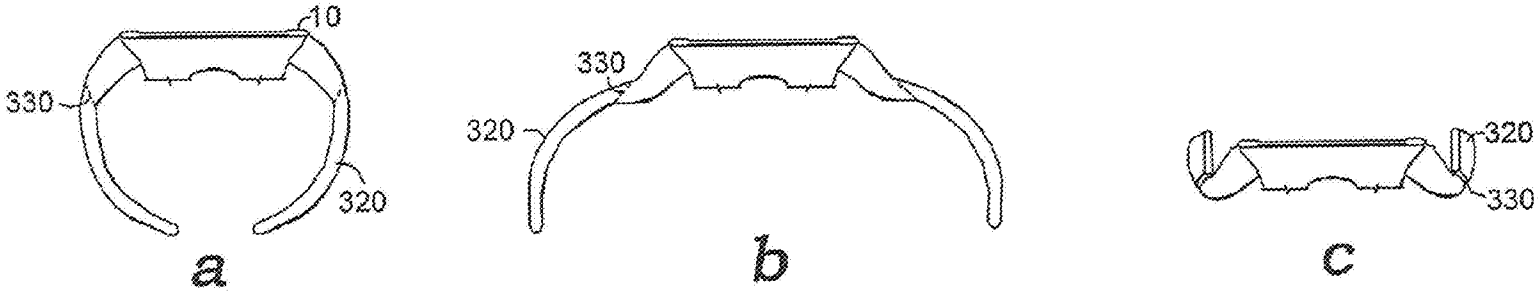
FIGS. 15*a-c* are a sequence of top plan views of the hip belt showing the folding of opposing portions of the hip belt about the diagonal fold seams.
Figure 16:
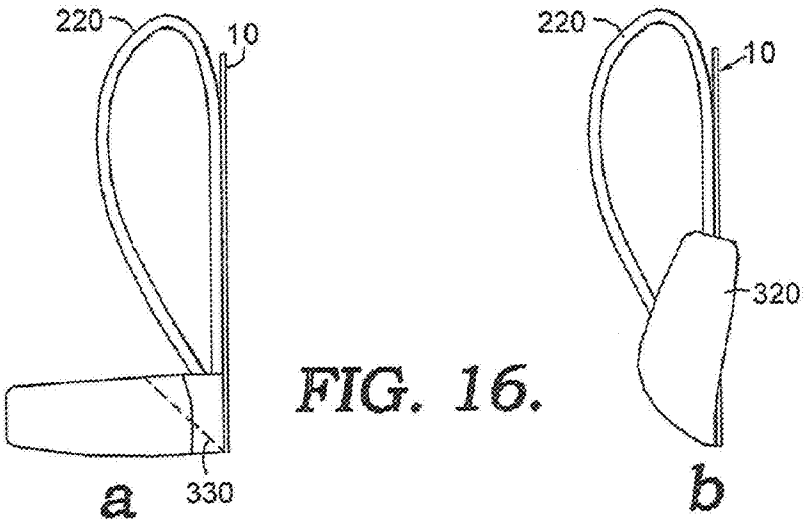
FIGS. 16*a* and 16*b* are a sequence of a side elevational views of the hip belt located with respect to the yoke showing the folding of opposing portions of the hip belt about the diagonal fold seams.

Attention is now directed to FIGS. 15 and 16. Another feature of the present invention is a folding hip belt 320 that is designed to fold along a seam 330, thereby reducing the space occupied by frame system 10 when not in use. Fold seam 330 allows each side of hip belt 320 to be folded up substantially vertically and can be constructed by interrupting the internal structure of hip pad 326, which is typically a foam-plastic combination. Preferably fold seam 330 is formed along an approximate 45-degree angle, with respect to the horizontal longitudinal axis of hip belt 320, enabling hip belt 320 to be folded upwardly at approximately 90 degrees or parallel with vertical sleeves 12, 13, and 14 or frame system 10. Alternatively, one or more fold seams 330 could be formed at any angle, thereby enabling hip belt 320 to be folded multiple times at any desired angle.

In one embodiment, fold seam 330 can be formed by molding a crease into the supporting material or by stitching the outer fabric membrane of hip belt 320 to the inner fabric membrane, through the internal structure of hip pad 326. This is similar to a preferred embodiment described above for creating flex lines 523 in spade 520. Alternatively, fold seam 330 can be formed using two separate pieces for the internal structure of hip bad 326 that abut ends along seam 330.

When hip belt 320 is folded upwardly as described above, the thickness of pack frame system 10 may be reduced by a factor of approximately 60%. By taking up less space, frame system 10 can be more easily and stably stored. Thus, one or more frames 10 with folded hip belts 320 may be stored in a space otherwise unsuitable for storing one or more conventional pack frames. For example, when used by soldiers, multiple frames 10 could be conveniently stored along the sides of a vehicle such as the interior walls of a helicopter, the bulkhead of a ship, or along the walls of a military transport vehicle. Furthermore, when hip belt 320 is folded upwardly, buckles 324 and strapping 322 of hip belt 320 are positioned adjacent to pack frame system 10 and are thus less likely to flop around, break, or become tangled with other objects. In one embodiment, an optional flap or pouch can be attached to each side of frame system 10 for stowing folded hip belt 320.

In a preferred embodiment, when hip belt 320 is folded upwardly, hip belt strap 322 may be extended vertically and used as a shoulder strap for transporting frame system 10. Where pouches are employed for stowing hip belt 320, the top end of the pouches may be left open enabling hip belt straps 322 and buckle 324 to be pulled through the opening and used as a shoulder strap.

Thus, the present invention provides simple, effective devices that overcome the problems associated with external and internal frame backpacks. From the foregoing, it will be seen that this invention is one well adapted to attain all the ends and objects herein above set forth together with other advantages, which are inherent to the structure and design. It will be understood that certain features and subcombinations are of utility and may be employed without reference to other features and subcombinations. This is contemplated by and is within the scope of the claims. Since many possible embodiments may be made of the invention without departing from the scope thereof, it is to be understood that all matter herein set forth or shown in the accompanying drawings is to be interpreted as illustrative and not in a limiting sense.

I claim:

1. A backpack comprising:

at least two generally upright stays in spaced apart relationship and having opposite ends;

at least two generally horizontal stays in spaced apart relationship and having opposite ends and having at least portions thereof extending between the upright stays;

a membrane extending between the horizontal and upright stays forming a first support structure therewith and operable to limit relative movement in a longitudinal direction of one upright stay relative to another upright stay;

a hip belt assembly connected to the first support structure;

a shoulder strap assembly connected to the first support structure;

at least one attachment device operatively associated with the first support structure for releasably mounting a cargo carrying device to the first support structure; and at least one cargo carrying device associated with the first support structure, said at least one cargo carrying device including at least one spade or connection strap received in a gap formed between a rearwardly facing surface of the membrane and a said generally horizontal stay that overlies the rearwardly facing surface of the membrane.

2. The backpack of claim 1 wherein the upright stays being connected to the horizontal stays by flexible connectors.

3. The backpack of claim 2 wherein the membrane being at least partially constructed of material selected from the group consisting of fabric and polymeric film.

4. The backpack of claim 2 wherein the flexible connectors including at least fabric.

5. The backpack of claim 4 including sleeves each receiving a respective said stay therein, said sleeves each having opposite closed ends with a respective said stay being captured between opposite closed ends.

6. The backpack of claim 5 wherein the sleeves being formed of fabric and the sleeves for the upright stays being attached to said membrane adjacent marginal edge portions of said membrane.

7. The backpack of claim 6 wherein the stays being generally flat rectangular members lying generally in a plane of the membrane.

8. The backpack of claim 1 wherein the stays being positioned relative to one another and associated with the membrane in a manner wherein when a generally longitudinally directed force is applied to an upright stay, the membrane will transmit a portion of the force to the other upright stay and provide a biased force in the membrane between the upright stays with at least a portion of the force being directed in a diagonal direction placing a portion of the membrane in tension between diagonally opposite corner portions of the membrane.

9. The backpack of claim 1 wherein the at least one cargo carrying device including a bag removably mounted to the first support structure.

10. The backpack of claim 9 including a retainer assembly connected to the bag and the first support structure to releasably retain the spade in the gap.

11. The backpack of claim 1 wherein said cargo carrying device is a load carrier, said load carrier including a retainer and a load shelf connected to the retainer, wherein a portion of said spade being adapted for folding to overlie a portion of the load shelf.

12. A backpack frame and support structure including:

a pack frame assembly comprising a plurality of stays positioned relative to one another to form a polygon having at least four sides, said stays being semi-rigid and being connected by flexible connectors adjacent ends of the stays forming corners, said stays being captured by portions of the pack frame assembly to substantially limit longitudinal movement of the stays relative to the pack frame assembly, said pack frame assembly further including a member connected between at least some of the stays and operable to provide reinforcement between pairs of abutting stays to limit flexing of the flexible connector between each pair and limit enlargement of an included angle between abutting stays foaming the included angle;

a hip belt assembly connected to the pack frame assembly;

a shoulder strap assembly connected to the pack frame assembly; and at least one cargo carrying device, said at least one cargo carrying device including at least one spade or connection strap received in a gap formed between a rearwardly facing surface of the member and at least one of said stays that overlies the rearwardly facing surface of the member.

13. A backpack frame and support structure as set forth in claim 12 wherein the shoulder strap assembly is mounted to the pack frame assembly in an adjustable manner to selectively change the spacing between a shoulder strap assembly yoke and the hip belt assembly.

14. A backpack frame and support structure as set forth in claim 13 including a hook and loop fastener device having a hook member and loop member one being attached to the shoulder strap assembly and the other being attached to the pack frame assembly, said hook member and loop member being attachable to one another at various locations to permit spacing adjustment of the shoulder strap assembly relative to the hip belt assembly.

15. A backpack frame and support structure as set forth in claim 12 wherein certain of said stays being positioned in a generally rectangular array and including generally upright stays and cross stays.

16. A backpack frame and support structure as set forth in claim 15 wherein said stays each being positioned in a respective sleeve member and being captured between opposite ends of the sleeve member to prevent substantial longitudinal movement within a sleeve formed by a respective sleeve member.

17. A backpack frame and support structure as set forth in claim 16 wherein the member including a membrane having side marginal portions connected to the upright sleeve members and extending therebetween.

18. A backpack frame and support structure as set forth in claim 17 wherein the stays including a plurality of generally upright stays and a plurality of cross stays, at least one cross stay extending between outermost positioned upright stays at a position intermediate an upper and a lower cross stay and overlying the rearwardly facing surface of said member forming said gap therebetween.

19. A backpack frame and support structure as set forth in claim 18 including a generally upright stay positioned intermediate the outermost upright stays and being received in a respective sleeve member mounted to the membrane.

20. A backpack frame and support structure as set forth in claim 12 wherein the shoulder strap assembly being removably mounted to a central portion of the pack frame assembly and portions above the central portion being free of attachment to the member.

21. A backpack frame and support structure as set forth in claim 20 wherein the shoulder strap assembly including a laterally centrally located yoke portion and a pair of shoulder strap portions connected to the central yoke portion.

22. A backpack frame and support structure as set forth in claim 21 including a hook and loop fastener device having a hook member and loop member, one of said hook member and loop member being attached to said pack frame assembly and the other of the hook member and loop member being attached to the shoulder strap assembly, said shoulder strap assembly being selectively movable longitudinally relative to the pack frame assembly.

23. A backpack frame and support structure as set forth in claim 22 wherein the hook and loop fastener device having a selectively exposable edge portion to provide access for a blade to be selectively inserted between the hook member and loop member to effect separation thereof and to permit relative movement therebetween for repositioning and height adjustment of the shoulder strap assembly relative to the hip belt assembly.

24. A backpack frame and support structure as set forth in claim 12 wherein the stays including at least two cross stays and at least two generally upright stays, each said stay being mounted in a respective said sleeve, said sleeves being connected to one another adjacent abutting end portions thereof and inside edges of the sleeves for the upright stays being connected to the member.

25. A backpack frame and support structure as set forth in claim 24 wherein the gap is defined between the member and at least some of the cross stays.

26. A backpack frame and support structure as set forth in claim 25 wherein the stays including a semi-rigid member received each in a respective said sleeve, said sleeves being connected together adjacent end portions thereof with the material of the sleeves forming flexible joints between the sleeves.

27. A backpack frame and support structure as set forth in claim 26 wherein the cross stays and generally upright stays forming a generally rectangular array with an included angle defined between immediately adjacent stays, and flexible joints allowing enlargement of an included angle of up to about 8° during longitudinal impact loading of a generally upright stay without permanent deformation of the flexible joints with further enlargement being resisted also by the member.

28. A backpack frame and support structure as set forth in claim 12 wherein the at least one cargo carrying device is removably mounted to the pack frame assembly.

29. A backpack frame and support structure as set forth in claim 28 wherein the at least one cargo carrying device including a cargo support assembly comprising a front panel connected to a load shelf and at least one said spade connected to the load shelf and strap members connected to and extending between an upper portion of the front panel and opposite sides of the pack frame assembly, said cargo support assembly spade being releasably mounted to the pack frame assembly, said cargo support assembly forming an upwardly opening receptacle for receipt of a portion of a person or cargo therein.

30. A backpack frame and support structure as set forth in claim 29 wherein the cargo support assembly spade being received through the gap and further including a retainer assembly releasably retaining the spade positioned in the gap.

31. A backpack frame and support structure as set forth in claim 30 wherein there being a plurality of said cross stays, each with a respective said gap, said spade extending through a plurality of said gaps.

32. A backpack frame and support structure as set forth in claim 18 further including a generally upright first member mounted to one of said pack frame assembly and shoulder strap assembly generally intermediate two outermost said generally upright stays, said first member being received in a pocket and being permanently deformable to provide a selected contour.

33. A backpack frame and support structure as set forth in claim 12 wherein the hip belt assembly including a pair of side portions each with a free end and each extending from a respective opposite side of said pack frame assembly, said side portions being padded, each said side portion having a fold line diagonal to a longitudinal axis of the respective side portion whereby each side portion having an end portion between a respective fold line and free end movable upwardly about the respective fold line.

* * * * *